United States Patent [19]

Tatsuzawa

[11] 4,151,649

[45] May 1, 1979

[54] UNIVERSAL PARALLEL RULER DEVICE

[75] Inventor: Hajime Tatsuzawa, Tokyo, Japan

[73] Assignee: Mutoh Industry, Ltd., Tokyo, Japan

[21] Appl. No.: 831,681

[22] Filed: Sep. 8, 1977

[30] Foreign Application Priority Data

Sep. 17, 1976 [JP] Japan ..... 51-110779

[51] Int. Cl.[2] ..... B43L 13/08

[52] U.S. Cl. ..... 33/76 R; 33/1 N; 33 79 R/

[58] Field of Search ..... 33/1 M, 1 N, 76 R, 79 R, 33/80; 250/231 SE

[56] References Cited

U.S. PATENT DOCUMENTS

| | | | |
|---|---|---|---|
| 3,339,285 | 9/1967 | Baker et al. | 33/79 R |
| 3,728,551 | 4/1973 | Culver et al. | 350/231 SE |
| 3,908,275 | 9/1975 | Shimizu | 33/76 R |

FOREIGN PATENT DOCUMENTS

| | | | |
|---|---|---|---|
| 2504579 | 8/1975 | Fed. Rep. of Germany | 33/79 R |

*Primary Examiner*—Richard E. Aegerter
*Assistant Examiner*—John W. Shepperd
*Attorney, Agent, or Firm*—Wenderoth, Lind & Ponack

[57] ABSTRACT

A universal parallel ruler device has a head supported shiftably with its fixed posture being maintained in a desired direction along the surface of a drafting board, a straightedge mounted swivelably in a plane parallel to the surface of the drafting board, an A-D converter for converting the angular position of the straightedge relative to the base line set to any given digital amount, a detector for detecting polarity of the straightedge relative to the base line, i.e. whether the straightedge relative is inclined to the clockwise rotation side of the base line or is inclined to the counterclockwise rotation side, and a display device for displaying the digital angular position of the straightedge and the polarity relative to the base line on the basis of the signal from the A-D converter.

16 Claims, 27 Drawing Figures

UNIVERSAL PARALLEL RULER DEVICE

DESCRIPTION OF PRIOR ART

The universal parallel ruler device of the kind according to this invention comprises a head supported for shifting movement along the surface of a drafting board with its fixed set posture being maintained, a ruler mounting plate mounted swivelably on the head, and a straightedge fixed to the ruler mounting plate. The rotary position of the straightedge in the plane parallel to the surface of the drafting board is displayed as an analog amount by a display means consisting of a graduation, or an index interlocked with the straightedge or an indicator. Accordingly, in case of reading the angular position of the straightedge, the reading is greatly influenced by the subjectivity of the operator and there is a drawback that the angular position of the straightedge cannot be read rapidly and accurately.

SUMMARY OF THE INVENTION

The present invention relates to a universal parallel ruler device wherein the head on which the straightedge is rotatably mounted is shiftable to any given position on the drafting board by manual operation, and more particularly to a universal parallel ruler device for displaying the polarity and angular position of the straightedge relative to the base line digitally.

A primary object of the present invention is to display the angular position of the straightedge mounted swivelably on the head relative to the base line as a digital amount and to display the polarity of the straightedge relative to the base line and yet to read out to the operator the angle of the straightedge to the base line rapidly and accurately. The base line mentioned above is a straight line which becomes a base when the drafting is carried out and becomes a zero value of the angle of the straightedge.

Another object of the present invention is to save electric power in the operation of the encoder and digital display means.

When the angle of the straightedge is displayed digitally, the encoder for converting the swiveling motion of the straightedge to a digital pulse signal normally employs a light emitting element such as a light emitting diode and a light receiving element such as a phototransistor. Accordingly, in case a battery is employed as an electric power source, the electric power consumption of the encoder is not reduced, and a problem arises that the service life of the battery is short. Also, the digital display means for displaying the angle of the straightedge normally employs liquid crystals, light emitting diodes or a display tube, and the like. The saving of the electric power of the digital display means is required for the purpose of not only prolonging the service life of the battery but also prolonging the service life of the elements constituting the display means such as the liquid crystal even in case the electric power source is supplied from a power line rather than a battery. In a universal parallel ruler device of this kind, indexing means for fixing the straightedge detachably to the non-rotating portion of the head for each 15° of swiveling, and angle fixing means for locking the straightedge to the non-rotating portion of the head at given angles are provided. An actual practice, the requirement that the angle of the straightedge by displayed occurs only when the straightedge is movable freely in the swiveling mode, and when the straightedge is fixed, the display of the angle of the straightedge is not required too much. For the foregoing reason, the present invention is constructed in such a way that even if the power source switch is in the ON condition, the supply of electricity to the encoder and the digital display unit is limited to the time when it is freely movable in the swiveling mode and when the straightedge is fixed to the non-rotating portion of the head, the supply of electricity to the encoder and the digital display means is interrupted, whereby a saving of electricity is achieved.

Still another object of the present invention is to prevent miscount of the counter arising from the incorporation of an electricity saving circuit into the electronic circuit of the present device.

Only when the straightedge is in the rotatable condition is the supply of electricity to the light emitting element of the encoder effected, and when the straightedge is fixed to the non-rotating portion side of the head, and the electric power saving means for interrupting the supply of electricity to the light emitting element of the encoder is employed, when the fixing of the straightedge is released, and when the light emitting element of the encoder is illuminated, a change occurs in the electronic circuit element and the counter is operated and miscounting of the counter occurs, and the angle of the straightedge is not digitally and accurately counted, which is a drawback of such a construction. An object of the present invention is to eliminate this drawback.

Also, when the straightedge is fixed to the non-rotating portion of the head, a slit disc of the encoder is vibrated by the shock generated at the time of fixing, and due to this vibration, a pulse is generated, and during the generation of this pulse, the encoder becomes OFF and there is a drawback that the accurate angle of the straightedge is not displayed by the display means.

Still another object of the present invention is to eliminate the foregoing drawback.

A still further object of the present invention is to provide the supply of electricity to the encoder just before the straightedge mounting member becomes rotatable when the straightedge mounting member is changed to the rotatable condition from the fixed condition. With this arrangement, the straightedge is not rotated in the non-count condition, and as a result, the miscounting of the angle of the straightedge can be prevented. Moreover, it allows the display of the angle of the straightedge on the display means digitally at a desired time while the straightedge mounting member is fixed to the non-rotating portion of the head.

For saving electricity, in the condition where the display means is not lighted, in case the electronic circuit is reset, in order to confirm whether the reset is properly performed, a straightedge fixing and releasing manipulating member is manipulated and the display means must be lighted. Namely, two operations, a reset switch manipulating operation and an operation of manipulating the straightedge fixing and releasing manipulating member are required, which makes the reset manipulation a complicated one. A still further object of the present invention is to change the display means temporarily to the display condition when the reset switch is actuated, and to cause the confirmation of the reset condition of the electronic circuit by the reset switch manipulation only.

In this kind of the device, in the resetting of the display means it is a general practice to set a certain base line and to rotate the straightedge through a certain angle. Accordingly, after the operation of pressing the reset switch button, the operation of rotating the straightedge immediately continues. In this case, due to a small amount of carelessness, while the reset switch button is being pressed down, the straightedge maybe rotated, and in the middle of the rotation, there is a possibility of erroneous by removing the finger from the reset switch button. Another object of the present invention is to show the non-count condition when the display means is extinguished while the reset switch button is pressed down by the operator, namely, the reset signal is being inputted to the electronic circuit, and the zero is displayed simultaneously by keeping the finger off the reset switch button, and the rotary motion count condition of the straightedge is displayed, whereby an erroneous operation can be prevented.

Still another object of the present invention is to display zero on the display means when the straightedge is rotated through a complete rotation from the zero position, namely, it is rotated through 360°.

In the analog display means employing a graduation and an index, where the straightedge is rotated once from the 0° position, as a matter of course, the straightedge returns to the 0° position again. However, in the A-D converting circuit employing an incremental type encoder, the angle of the straightedge is converted to a pulse signal, and this pulse signal is sequentially added, and therefore when the straightedge is rotated once in the counterclockwise direction to the base line, the position is +360°00′, and when the straightedge is rotated once in the clockwise direction, the position becomes −360°00′. This causes various inconveniences in many cases. It is desirable in the universal parallel ruler of this kind to count the swiveling angle of the straightedge so that the above-mentioned +360°00′ and −360°00′ become 0.

A still further object of the present invention is to rotate a pulse transmitting member such as slit disc forming the encoder at a speed faster than the rotary speed of the straightedge. When the pulse transmitting member is connected to accelerating means, the rotation of the pulse transmitting member can be set so that it becomes several times the amount of rotation of the straight edge. With this construction, it is possible to obtain a pulse transmitting member having high accuracy without marking the member of slits for pulse generation by the pulse transmitting member or the pattern very high, and the manufacture of the member becomes easier. Accordingly the manufacturing cost of the pulse transmitting member can be reduced, and at the same time, the pulse transmitting member can be made in a compact size, and also the A-D conversion of the fine adjustment angle of the straightedge can be performed with high accuracy.

A still further object of the present invention is to make the straightedge rotatable 7.5° in each direciton, a total of 15° from the position where the straightedge is fixed by indexing means having an indexing function for adjustably fixing the straightedge mounting member at each 15° interval. With this arrangement, when the straightedge mounting member is fixed by the indexing means, even if the straightedge does not align with the desired straight line on the drawing, the straightedge can be adjusted so that it is in alignment with the desired straight line on the drawing. If the counter is cleared in the aligned condition, the desired straight line can be set on the base line without spoiling the index pattern of the indexing means.

A still further object of the present invention is to provide a plurality of settings for the zero standards of measurement of the angle of the straightedge. With the provision of a plurality of zero standards with respect to the swiveling angles of the straightedge, a plurality of angle which are based on the respective zero standards are counted. The angle of the straightedge from the desired zero standard can be displayed by the display means. The function of setting a plurality of zero standards of the straightedge angle, namely, a multiplex protracting function is retained in the universal parallel ruler device, whereby the drafting manipulation can be done efficiently.

A still further object of the present invention is to provide means to convert the digital angle of the straightedge to a desired angle function, for example, a tangent value, and the angle function value can be digitally displayed. For example, in the making of drawings for the construction of buildings, there are circumstances in which the tangent values of the angle and the like are required. In this case, the converstion of the angle of the straightedge to the tangent value each time it is desired is extremely troublesome, which prevents efficient drafting manipulation. With the present arrangement the angle of the straightedge is converted to the value of the desired function of the angle and it is displayed, whereby the foregoing drawback can be eliminated.

A still further object of the present invention is to miniaturize the head. When displaying the angle of the straightedge digitally in the universal parallel ruler device, a battery for driving the digital electronic device is required. When the space for housing the battery is specially provided in the head a considerable space is needed, and as a result the dimension of the entire head becomes big. However, the manipulating handle of the universal parallel ruler of this kind has a cavity in its inside. Therefore, an object of the present invention is to make the size of the head small by providing a battery housing portion in the cavity portion in the manipulating handle.

A still further object of the present invention is to hold an opposed interval of a pulse transmitting member of the encoder and a detector for detecting the slits of the pulse transmitting member to a constant always and with high precision and to eliminate the missing of pulse detecting by the detector.

Other objects and advantages of the present invention will become obvious from the following description and accompanying drawings.

The drawings show preferred embodiments of the present invention, and the description will be given with respect to such embodiments. However, it should be understood that various modifications of the disclosed construction, are possible and that the drawings and descriptions do not define or limit the scope of the present invention.

DETAILED DESCRIPTION OF THE INVENTION

Figure 1:
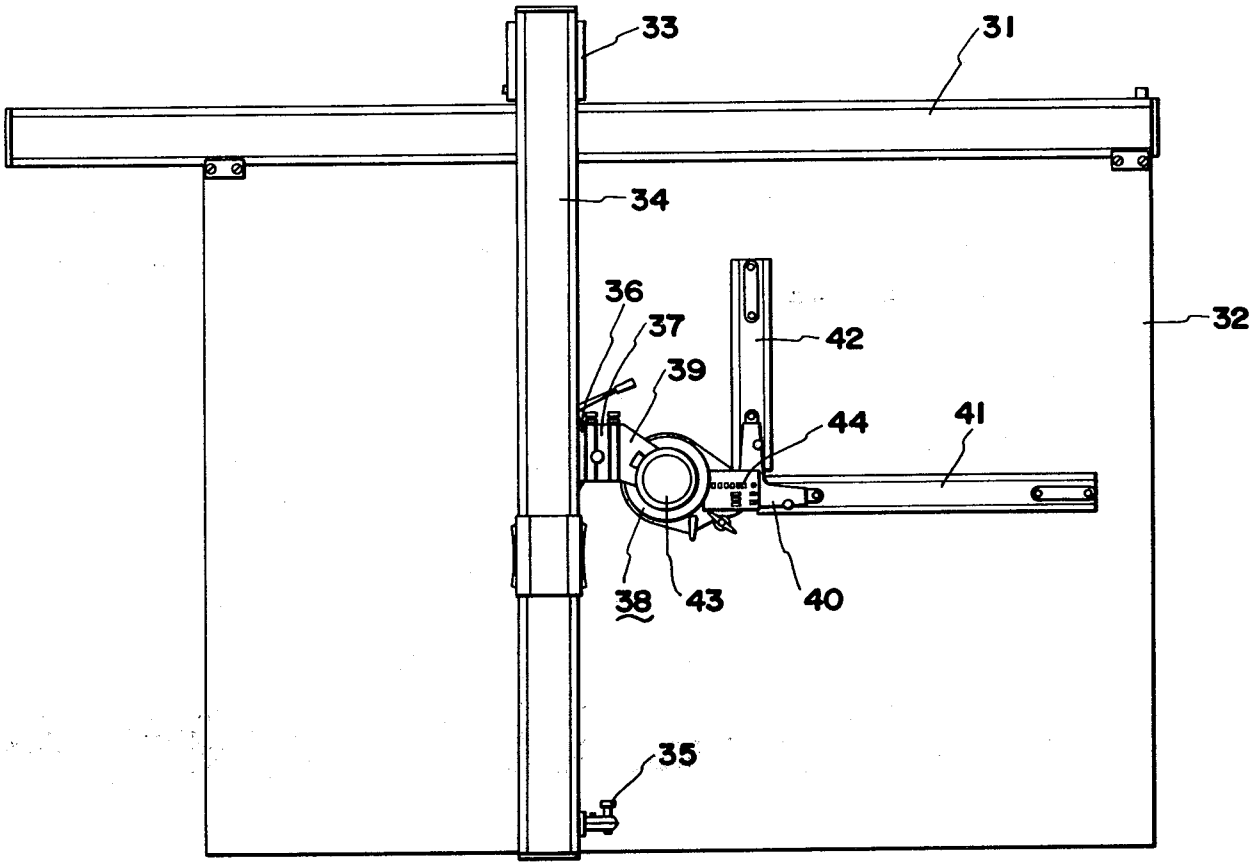
FIG. 1 is a general plan view of the universal parallel ruler device of the present invention.
Figure 2:
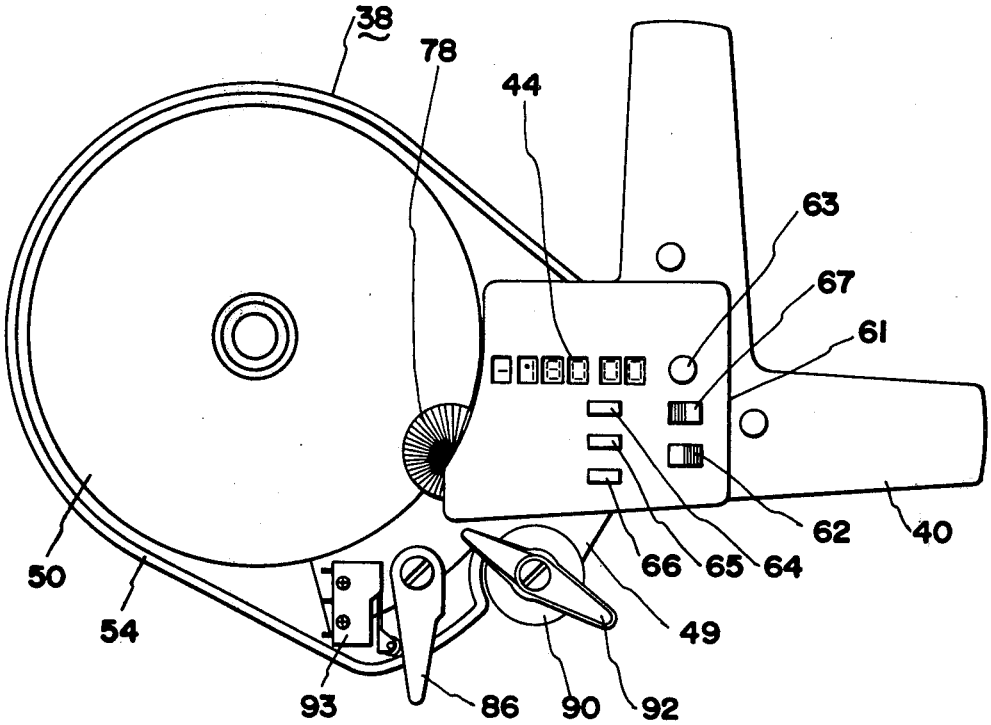
FIG. 2 is a plan view, on an enlarged scale, for the ruler device.
Figure 3:
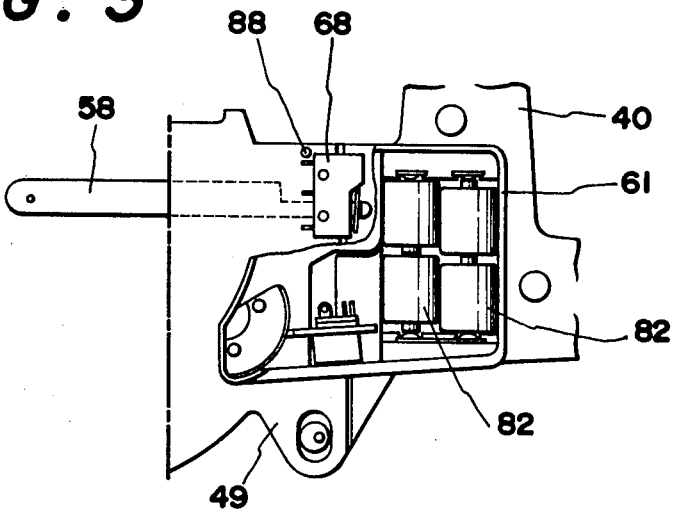
FIG. 3 is a plan view of a base plate and ruler mounting plate of the ruler device.

In FIG. 1, reference numeral 31 denotes a lateral rail fixed to the side portion of a drafting board 32, and which is connected to a lateral cursor 33 slidable along the longitudinal direction of the lateral cursor. Numeral 34 denotes a vertical rail, and one end portion thereof is rotatably connected to the lateral cursor 33 for rotation in the plane pendicular to the plane of the drafting board 32. A tail roller 35 is rotatably connected to the other end of the vertical rail 34, and the tail roller 35 rests on the surface of the drafting board 32. Numeral 36 denotes a vertical cursor slidably mounted on the vertical rail 34 of movement along the longitudinal direction of rail 34, and the cursor 36 is connected to a support member 39 of a head 38 by a hinge connecting portion 37. A ruler mounting member 40 which is one of the elements constituting the head 38 has straight edges 41 and 42 detachably mounted thereon. When a handle 43 which is one of the elements of the head 38 is rotated manually, the ruler mounting member 40 is rotated in a plane parallel to the plane of the drafting board 32 centering around the handle 43. The angle of the straightedges 41 and 42 to a base line can be changed by the rotation of the ruler mounting member 40. The angle of the straightedge 41 to the base line is displayed digitally on the display means 44 of the head 38. The base line is a straight line parallel to the straightedge 41 when the display means 44 is zero, namely, the counter for counting the angle of the ruler is reset to zero.

The display means 44 consists of liquid crystals, but other materials such as light emitting diodes, and display tubes may be used. The handle 43 of the head 38 is gripped by hand, and when a force is applied to the head 38 in any given direction parallel to the plane of the drafting board 32, the head 38 and the straightedges 41 and 42 shift to any given positions on the surface of the drafting board 32 by the transfer of the cursor 33 along the lateral rail 31 and the transfer of the vertical cursor 36 along the vertical rail 34.

Next, the construction of the head 38 will be described by referring to FIG. 2 through FIG. 9.

Figure 4:
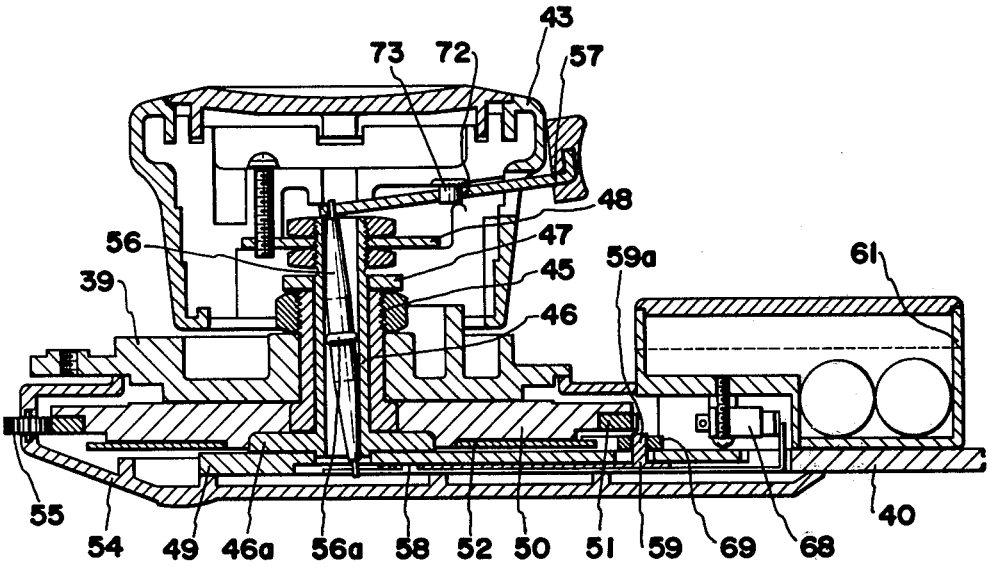
FIG. 4 is a cross section of the head of FIG. 2.
Figure 5:
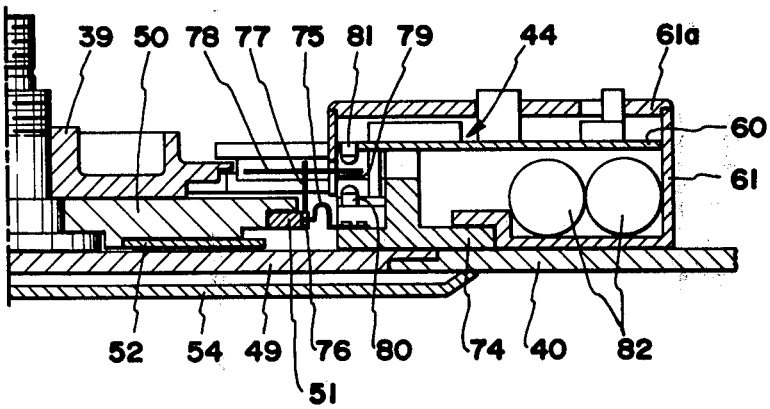
FIG. 5 is a cross section showing an incremental encoder built in the head.
Figure 6:
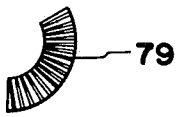
FIG. 6 is a plan of a vernier slit semicircular disc of the ruler device.
Figure 8:
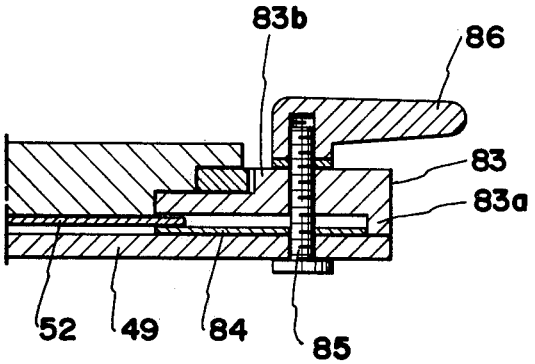
FIG. 8 is a cross section showing angle fixing means for the ruler device.
Figure 9:
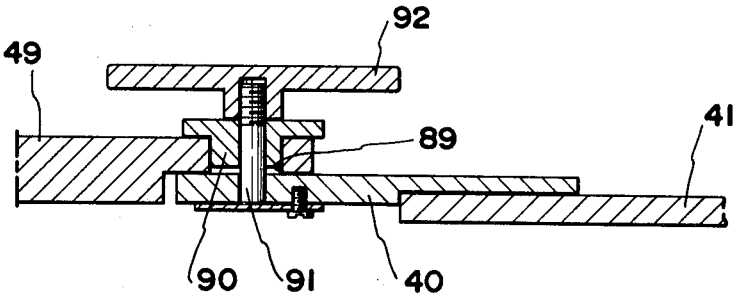
FIG. 9 is a cross section showing the connecting structure for the base plate of the ruler device and the ruler mounting plate.

Numeral 45 denotes an outer tube which is fixed to a pipe portion of the head support member 39, and the outer peripheral surface of an inner tube 46 is rotatably fitted into the outer tube 45. A stop panel 47 fixed to the outer peripheral portion of the inner tube 46 abuts the upper end surface of the outer tube 45 with its bottom surface. The numeral 43 denotes the handle, and a panel member 48 is fixed to the handle 43, and the member 48 is fixed to the upper end of the inner tube 46 by a nut. A base plate 49 is fixed to the bottom end flange portion 46*a* of the inner tube 46. Numeral 50 denotes a panel that fits rotatably around the bottom end outer peripheral surface of the outer tube 45, and the panel 50 is fixed to the support member 39. A protracting gear 51 is fixed on the outer peripheral surface of the panel 50. Numeral 52 denotes an index ring fixed to the panel 50, and a concave recess 53 is formed at each 15° interval on the outer peripheral surface portion. Numeral 54 denotes a cover member detachably mounted on the base plate 49, and a gear 55 for fine adjustment is rotatably journaled on the cover member, and the gear 55 is meshed with the protracting gear 51. Numeral 56 denotes a conical bar and the conical bar is disposed in the inner tube 46 so that the bar 56 can move swivelably through a predetermined range of angles centering around its center enlarged diametral portion 56*a*. One end of a manipulating member 57 is connected to the upper end of the conical bar 56 with leeway, and one end of an elongated member 58 is connected to the bottom end of the conical bar 56 and an elongated member 59 is connected to the elongated member 58 so as to be interlocked therewith. Numeral 60 denotes a plate member built in a casing 61, and in the plate member, digital display means 4, electric power source switch 62, counter reset switch 63, addition key 64, memory clear key 65, memory read key 66, TAN/DEG changeover switch 67, and IC information processing circuit are disposed. The casing 61 is fixed to the base plate 49, and the switches 62, 63, 64, 65, 66 and 67 and display means 44 are exposed through openings formed in a cover of the casing 61. Numeral 68 denotes an index switch fixed to the bottom portion of the casing 61, and a raised portion of the elongated member 58 is opposed to the movable member of the switch member. A shaft 59*a* projects from the elongated member 59, and the shaft 59*a* is slidably fitted into a long hole 70 formed in a swiveling member 69. One end of the swiveling member 69 is rotatably pivoted on the base plate 49 at 71, and a pawl portion 69a on the other end of the swiveling member 69 is opposed to the outer peripheral surface of the index ring 52. The elongated members 58 and 59 are urged in the left direction in FIG. 4 by a spring member (not shown). FIG. 4 shows the condition where the manipulating member 57 is pressed in the left direction, and a hole 72 in the manipulating member 57 has a stop shaft 73 inserted therein and the manipulating member 57 is thus retained at the pushing leftmost position. The index ring 52 and the swiveling member 69 constitute the index means. Numeral 74 denotes a base fixed to the base plate 49, and a holding member 75 is fixed to the base, and the holding member 75 has a small gear 76 rotatably mounted thereon. The small gear 76 is meshed with the protracting gear 51, and a pulse transmitting member, namely, a slit disc 78 is fixed to the top end of the shaft 77 fixed to the small gear 76. The protracting gear 51 and the small gear 76 constitute the accelerating means for the pulse transmitting member 78. Numeral 79 denotes a vernier slit semicircular disc mounted on the casing 61 and the semicircular disc 79 is disposed adjacent and immediately below the slit disc 78 and parallel to the slit disc 78. Numeral 80 denotes a pair of light emitting elements disposed on the base 74 (light emitting diodes) (the other light emitting element is not shown), and a pair of light receiving elements 81 (phototransistors) which are mounted on the plate member 60 are disposed immediately above the elements 80, and the light receiving elements 81 and the light emitting elements 80 are on opposite sides of the slit disc 76 and the vernier slit semicircular disc 79. Numeral 82 denotes batteries disposed in the casing 61. FIG. 8 shows the angle fixing means. Numeral 83 denotes an L-shaped brake plate, and the bottom surface of the perpendicular portion 83a of the brake plate abuts the top surface of the base plate 49, and one of the horizontal portions 83a of the brake plate 83 is positioned on the top surface of the index ring 52. Numeral 84 denotes a receiving plate which is fixed to the top surface of the base plate 49, and the top surface of the receiving plate 84 is positioned on the bottom surface of the index ring 52. Numeral 85 denotes a screw lever fixed to the base plate 49, and the screw lever 85 is fitted relatively slidably in a hole formed in the brake plate 83, and a female thread portion of the angle fixing manipulating member 86 is screwed onto the upper portion of the screw lever 85. The ruler mounting plate member 40 is journalled rotatably on the base plate 49. An oblong hole 89 is formed at a position properly spaced from the journaled portion, and knob 90 is rotatably fitted into the hole 89. An eccentric shaft 91 is rotatably inserted into the knob 90, and a female thread portion of a lever 92 is screwed to the top end thread portion of the eccentric shaft 91, and the bottom end of the eccentric shaft is fixed to the ruler mounting member 40. The hole 89 and the knob 90 constitute the base line adjusting means. Numeral 93 denotes an angle fixing lever switch disposed on the base plate 49. The lever switch 93 and the index switch 68 constitute detecting means for detecting fixing of the ruler and releasing thereof. Next, the IC circuit information processing circuit of the present device provided on the plate member 60 in the casing 61 will be described by referring to FIG. 10 and FIG. 11.

Figure 10:
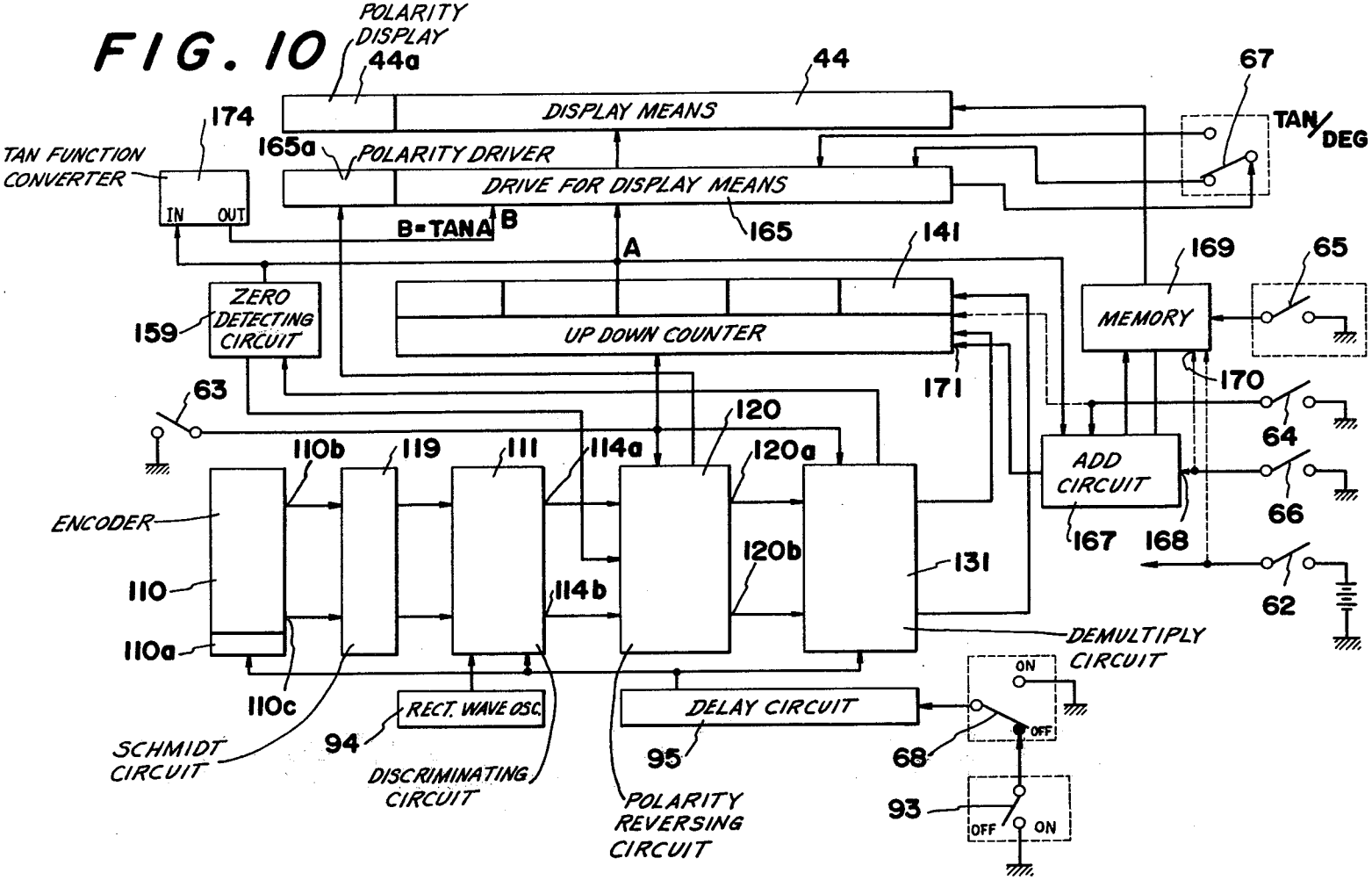
FIG. 10 is a block diagram of an electronic circuit of the present device.
Figure 11:
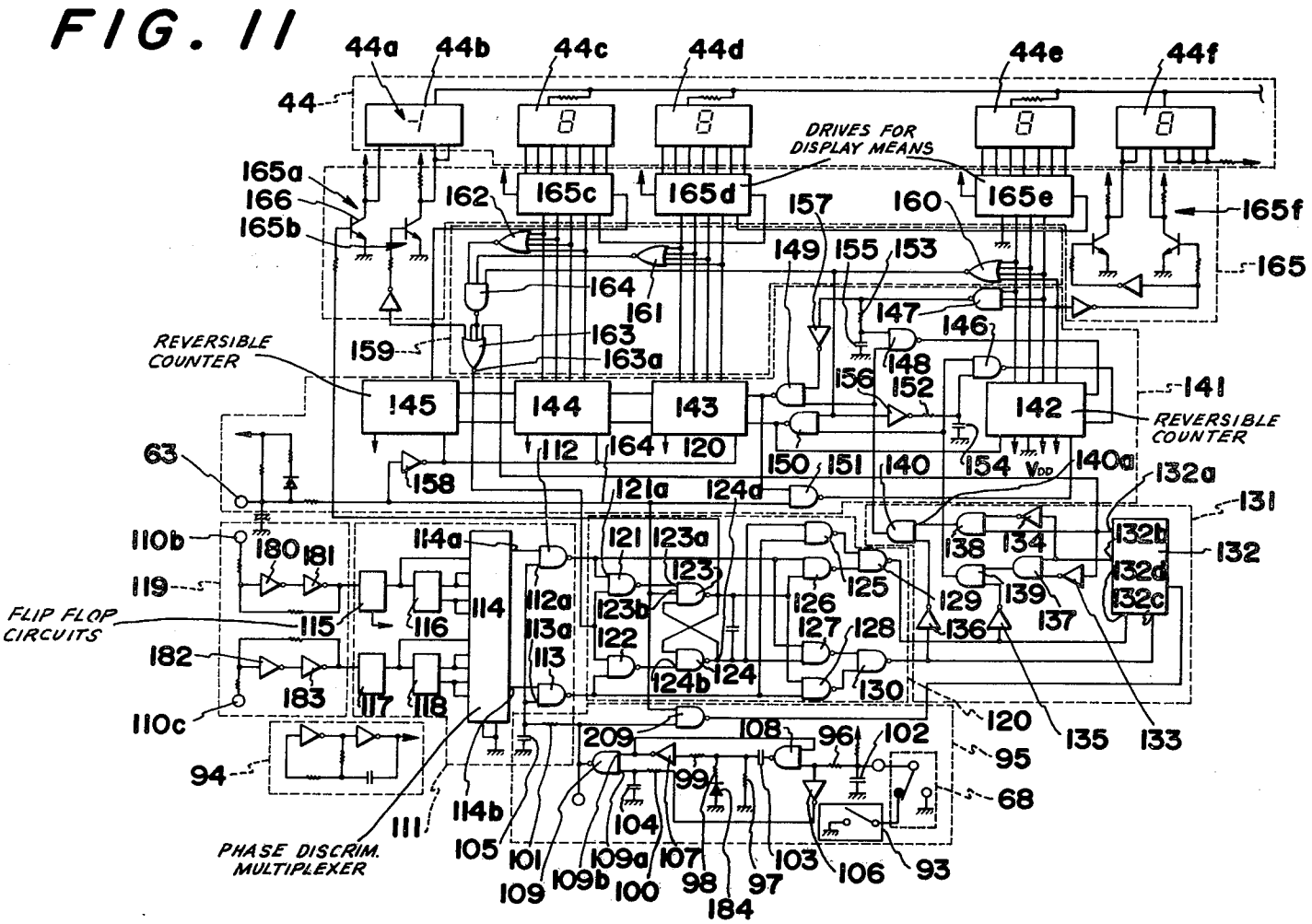
FIG. 11 is an electronic circuit diagram of the present device.

In the drawing, numeral 94 denotes a rectangular wave oscillator, and 95 denotes a delay circuit, and is composed of resistors 96–101, capacitors 102–105, inverters 106, 107, and NAND gates 108, 109, and 209, and the output terminal of the NAND gate 109 is connected to a control portion 110a of the light emitting element 80 which is an element of the encoder 110. An input terminal of an integrating circuit consisting of the resistor 101 and capacitor 105 is connected to the output terminal of the NAND gate 109, and the output terminal of the integrating circuit is connected to input terminals of the NAND gates 112, 113 of quadrupled pulse direction discriminating circuit 111. The discriminating circuit 111 comprises the NAND gates 112, 113, phase discriminating multiplexer 114, and flip flop circuits 115–118. The input terminals of the flip flop circuits are connected to an output terminal of Schmidt circuit 119 consisting of reversing Schmidt circuit elements 180–183, and the input terminal of the Schmidt circuit 119 is connected to the output terminal of the encoder 110. Numeral 120 denotes a polarity reversing circuit and is composed of NAND gates 121–130, and the NAND gates 123–124 constitute a flip flop circuit. Numeral 131 denotes a demultiply circuit, which is composed of a binary reversible counter 130, inverter 133–136, and AND gates 137–140. Numeral 141 denotes an updown counter, wherein a hexadecimal preset reversible counter 142 for binary notation, decimal reversible counters 143, 144, binary reversible counter 145, NAND gates 146–151, resistors 152, 153, capacitors 154, 155, and inverters 156–158 are connected as shown on the drawing. The hexadecimal preset reversible counter 142 uses a circuit of the least significant digit as the binary reversible counter, and a circuit of the other digits is used as an octal reversible counter. The NAND gate 147 is for detecting an output signal of 55 minutes from the counter 142. Numeral 159 denotes a zero detecting circuit, and is composed of NOR gates 160–163 and NAND gate 164. The output terminal of the NOR gate 163 is connected to input terminals of the NAND gates 121 and 122. A clear line 164 connected to the counter reset switch 63 is connected to input terminals of the NAND gate 123 and NAND gate 209. The output terminal of the NAND gate 109 is connected to the other input terminal of the NAND gate 209, and the output terminal of the NAND gate 209 is connected to the clear terminal of the counter 132. Moreover, the clear line 164 is connected to the clear terminals of the counters 145, 144 and 143 by means of the inverter 158, and is connected to the clear terminal of the counter 142 by means of the NAND gate 151. Numeral 165 denotes a drive for driving the display means 44, and is composed of a polarity driver 165a for driving the polarity display portion 44a, a decoder driver 165b for driving the 100° unit display portion 44b, and decoder driver 165c for driving the 10° unit display portion 44c, a decoder driver 165d for driving the 1° unit display portion 44d, a decoder driver 165e for driving the 10 minutes unit display portion 44e, and a decoder driver 165f for driving the 5 minutes display portion 44f. The base of the transistor 166 constituting the polarity driver 165a is connected to the output terminal of the NAND gate 125. In FIG. 10, numeral 167 denotes an addition circuit, and its output terminal is connected to an output terminal of the updown counter 141, and the memory read key 66 is connected to the read input terminal 168. The addition key 64 is connected to an input terminal of the addition instruction of the addition circuit 167, and the line connected to the memory read key 64 is connected to the clear terminal of the updown counter 141 by means of the delay circuit (not shown). Numeral 169 denotes a memory circuit, and its input terminal is connected to the output terminal of the addition circuit 167. The output terminal of the memory circuit 169 is connected to the second input terminal of the addition circuit 167. The memory read key 66 is connected to the clear input terminal 170 of the memory circuit 169 by means of a delay circuit (not shown). The output terminal of the addition circuit 167 is connected to the preset input terminal 171 of the updown counter 141. The output terminal of the memory circuit 169 is connected to the input terminal of the display means 44. The addition circuit 167 and the memory circuit 169 constitute the multiplex protracting circuit. Numeral 174 denotes a TAN function converting portion, and the input terminal thereof is connected to the output terminal of the updown counter 141, and the output terminal of the converting portion 174 is connected to the input terminal of the driver 165.

Next, the operation of the embodiment will be described.

In the first place, the electric power source switch 62 is turned ON. In a general case where the angle and numeral value are displayed on the display means 44, TAN/DEG changeover switch 67 is moved to the DEG position.

Figure 7:
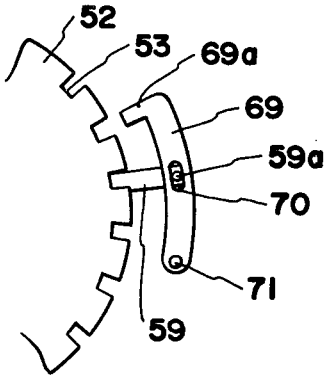
FIG. 7 is a plan showing indexing means for the ruler device.
Figure 13:
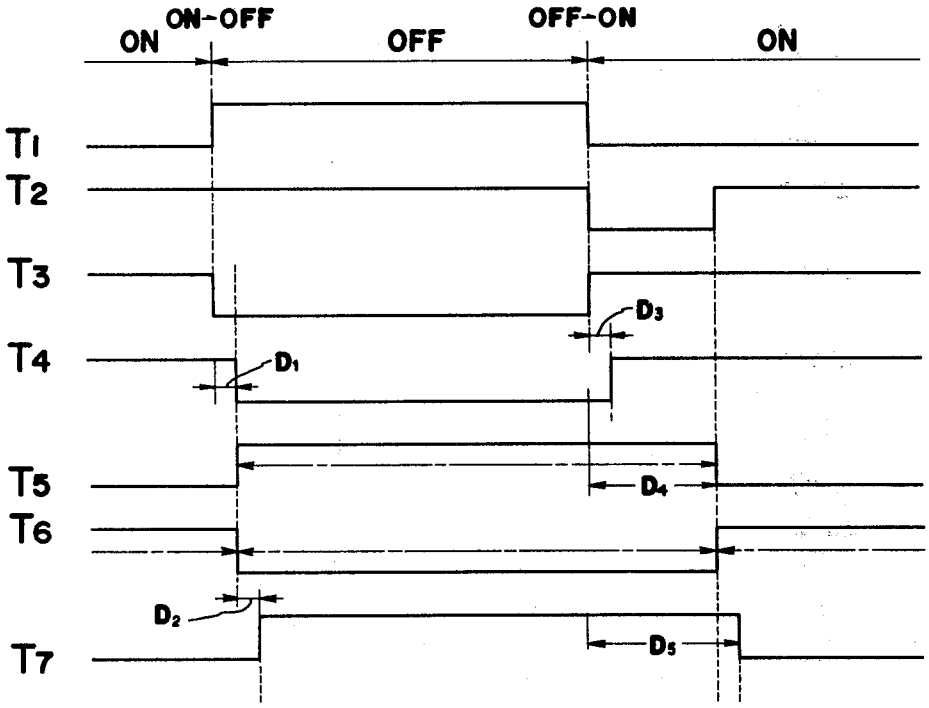
FIG. 13 is a time chart for explanation of the operation of a delay circuit.
Figure 14:
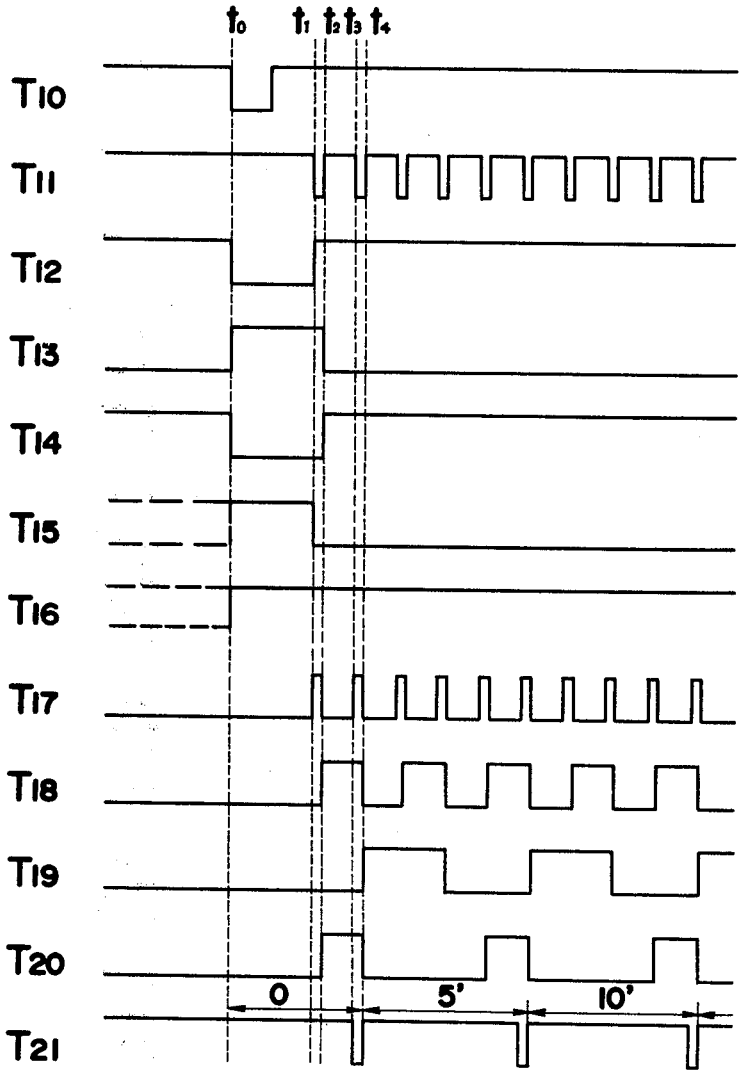
FIG. 14 is a time chart for explanation of the operation of the electronic circuit of the present device.

When the angle fixing manipulating member 86 is rotated in the releasing direction, the pressure of the end surface of the manipulating member 86 against the brake plate 83 is released, and the holding of the base plate 49 and the panel 50 by the brake plate 83 is released. The switch 63 is turned OFF by the turning of the angle fixing manipulating member 86 in the releasing direction. Next, the manipulating member 57 is pressed down in the left direction on the drawing as shown in FIG. 4, and the elongated member 59 is shifted in the right direction against the resiliency of the spring, and the swiveling member 69 is swiveled in the clockwise direction around the shaft 71 as shown in FIG. 7, and the pawl 69*a* is moved away from the concave portion 55 of the index ring 52. At this time, the index switch 68 is turned OFF, and High signal "1" is inputted to the input terminal of the delay circuit 95, namely, the input terminal of the inverter 106 with a signal form T1 shown in FIG. 13, and the polarity of the signal is reversed with a signal form T3. Moreover, a signal having a polarity which is reversed in inputted with a signal form T4 to the input terminal 109*a* of the NAND gate 109 after a time $D_1$ through the integrating circuit of the resistor 100, and capacitor 104. Then the High output "1" of the NAND gate 109 is transmitted to an LED portion 110*a* of the encoder 110 with a signal form T5, and after the index switch 118 is turned off, and after the time $D_1$ has elapsed, the light emitting diode 80 (LED) of the decoder 110 is illuminated. Also, the output "1" of the NAND gate 109 is impressed with a signal form T7 on each input terminal 112*a*, 113*a* of the NAND gates 112 and 113 through the integrating circuit consisting of the resistor 101 and capacitor 105. Then the gates of the NAND gates 112 and 113 become conductive after a delay of time $D_2$ after the encoder 110 is turned ON. The gates of the NAND gates 112 and 113 become conductive the updown counter 141 starts to count. The reason for generating the delay time $D_2$ by the delay circuit 94 after the light emitting element 80 is illuminated until the NAND gates 112 and 113 become conductive is based on the following. When the index switch 68 is turned OFF and the LED 80 is illuminated, the level of the output terminal of the encoder 110 changes and with the level change, the NAND gates 112 and 113 become conductive, the NAND gates perform the same operation when supplied with a pulse, and the pulse is supplied to the updown counter 141, and as a result there is a possibility that the updown counter 141 will operate. With the delay, even if the pulse signal generated at the time of illumination of the LED is supplied to the NAND gate 112 or 113 from the output is interrupted, there is no chance that the updown counter 141 will operate due to the pulse signal, and thus generation of an angle display error can be prevented. When the NAND gates 112 and 113 are in the conductive condition and the handle 43 is gripped, and the handle 43 is rotated, and the tubes 45 and 46 are rotated, the base plate 49, ruler mounting member 40 and straightedges 41 and 42 are rotated in the plane parallel to the plane of the drafting board 32 by being interlocked with the tubes 45 and 46. With the rotation of the base plate 49, the small gear 76 is rotated because it is meshed with the gear 51 along the protracting gear 51 and the slit disc 78 is rotated. With the rotation of the slit disc 78, two kinds of pulses which are 90° out-of-phase are outputted from the output terminal of the encoder 110, namely, SIN pulse and COS pulse. The waveforms of these SIN and COS pulse signals are shaped by the reversing Schmidt circuit elements 180, 181, and 182 and 183. This waveform is made to generate a time delay through the flip flop circuits 115 and 116, and 117 and 118, whereby the pulse is multiplied four times by the phase discriminating multiplexer 114. Whether or not this quadrupled pulse appears at the output terminal 114*a* or 114*b* is determined by the phase of the input pulse. Namely, when the handle 43 is rotated in the counterclockwise direction in FIG. 1, at the output terminal 110*b* of the encoder 110, the SIN pulse is outputted, and at the output terminal 110*c*, the COS pulse is outputted, and the quadrupled pulse appears at the output terminal 114*a* of the phase discriminating multiplexer 114. Contrary to the above, when the handle 43 is rotated in the clockwise direction, the COS pulse is outputted at the output terminal 110*b* of the encoder 110, and the SIN pulse is outputted at the output terminal 110*c*, and the quadrupled pulse appears at the output terminal 114*b* of the phase discriminating multiplexer 114. Accordingly, at the time when the pulse from the output terminal 114*a* or 114*b* appears as the output, the output pulse of the encoder 110 is multiplied 4 times, and simultaneously the direction is discriminated. Now, with respect to the case where the pulse appears at the output terminal 114*a* of the multiplexer 114, a description will be provided according to the time chart as shown in FIG. 14.

At the time $t_0$, when a clear pulse like the signal T10 is supplied to the clear line 164 by turning the counter reset switch 63 ON, the content of the updown counter 114 always becomes zero, and therefore, the level at the output terminal 163*a* of the zero detecting circuit 159 becomes High like the signal T13. In this condition, the input sides 123*a* and 124*b* of the reset flip flop circuit become Low as shown by the signals T12 and T14. Accordingly, the output sides become High as shown by the signals T15 and T16. In this condition, at the time $t_1$, the timing pulse T11 appears at the output terminal 114*a* of the multiplexer 114 and passes the NAND gate 112 to enter the input terminal 121*a* of the NAND gate 121. When the level of the input terminal 121*a* and the output terminal 163*a* of the NOR gate 163 satisfies the conditions of the NAND, the pulse T11 is transmitted to the input terminal 123*a* of the NAND circuit 123.

Accordingly, with the signal T12, at the time $t_1$, the input terminal 123*a* of the NAND gate 123 becomes High. In this condition, the inversed input terminal 124*b* of the reset set flip flop circuit remains Low. Accordingly, it produces the similar effect that the downward pulse enters the NAND gate 124, and like the signal T15, the output terminal of the NAND gate 123 changes to Low from High.

Also, the waveform of the output terminal of the NAND gate 112 is inputted to each input terminal of the NAND gates 126 and 127. In this case, as described in the foregoing, after the time $t_1$, the output terminal of the NAND gate 123 becomes Low, and therefore the output of the NAND gate 112 is not outputted from the output terminal of the NAND gate 126, and is outputted from only the output terminal of the NAND gate 127. The waveform becomes the signal T17.

Figure 12:
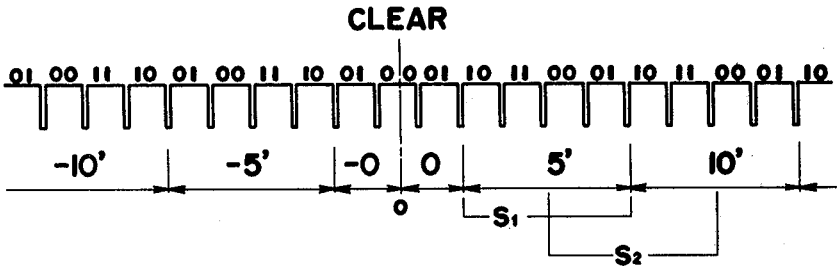
FIG. 12 is a time chart for explanation of the operation of a delay ¼ demultiply circuit.

On the other hand, the level of the output terminals 132*a* and 132*b* of the reversible binary counter 132 changes sequentially 01, 10, 11, 00, 01, 10, 11, 00, 01, 10, .... as shown in FIG. 12 as a pulse is supplied from the clear condition 00 to the upcount input terminal 132*c*. When the pulse is supplied to the downcount input terminal 132*d* of the reversible counter 132, the level changes sequentially to 01, 00, 11, 10, 01, 00, 11, 10, 01 for each pulse in case, for example, the input terminals 132*a*, 132*b* are in the 10 condition.

When the output terminals 132*a* and 132*b* of the counter 132 are in the clear condition of 00, and one pulse is supplied from the NAND gate 130 to the inverter 136 and the upcount terminal 132*c* of the counter, at the time $t_2$, the output terminal 132*b* remains 0 like the signal T19, but the output terminal 132*a* changes to "1" like the signal T18, and the level of the input terminal of the AND gate 138 becomes "11". Accordingly, the level of the input terminal 140*a* of the AND gate 140 becomes "1" like the signal T20, and when a pulse appears at the input terminal, the pulse is allowed to pass.

Next, at the time $t_3$, when the second pulse is supplied to the inverter 136, the pulse is reversed at the inverter 136 and is transmitted to the input terminal of the AND gate 140. In this case, since the input terminal 140*a* of the AND gate 140 was in the "1" condition previously, the pulse is outputted from the output terminal of the AND gate 140. The polarity of this pulse is reversed through the NAND gate 148, and is supplied to the upcount terminal of the reversible counter 142 like the signal T21.

The second pulse is supplied to the upcount terminal 132*c* of the counter 132 simultaneously with its supply to the inverter 136, and therefore at the time $t_4$, the output terminal 132*a* of the counter 132 changes to "0", and the output terminal 132*b* changes to "1" like the signals T18 and T19. Accordingly, the input terminal of the AND gate 138 becomes "00". Also, like the signal T29, the input terminal 140*a* of the AND gate 140 becomes "0". Therefore, the AND gate 140 changes to the condition where the pulse is not allowed to pass even though it is supplied to the other input terminal. Even if third and fourth pulses are supplied, the input terminal 140*a* of the AND gate 140 remains "0", and when the fifth pulse is supplied, it becomes "1" again, and condition where the next or sixth pulse is allowed to pass is generated. Namely, only when the level of the output terminals 132*a* and 132*b* of the reversible counter 132 becomes 1, 0, the AND gate 140 is opened, and the next pulse is supplied to the upcount terminal of the counter 142.

When the stop 73 is released from the hole 72 of the manipulating member 57, due to the elastic force of the spring, the manipulating member 57 is returned in the right direction in FIG. 4 and is shifted, and the elongated members 58 and 59 are shifted in the left direction, and the pawl portion 69*a* of the swiveling member 69 comes into resilient contact with the outer periphery of the index ring 52. In this condition, when the handle 43 is turned, the pawl portion 69*a* moves into the concave portion 53 of the index ring 52, and the base plate 49 is fixed to the panel 50. At this time, the index switch 68 is turned ON. Then the Low signal is transmitted to the input terminal of the NAND gate 108 of the delay circuit 95 as the signal T1. With this signal a one shot multivibrator consisting of a NAND gate 108, inverter 107, capacitor 103, diode 184, and resistors 97–99 is operated as a signal T2, and the level of the input terminal 109*b* of the NAND gate 109 changes like the signal T2. On the other hand, the signal ON of the index switch 68 is inputted to the inverter 106, and the polarity thereof is reversed by the inverter 106, and moreover it is inputted to the NAND gate 109 with a delay of the time $D_3$ through the integrating circuit. The NAND output of the timing T5 of the NAND gate 109 is inputted to the clear terminal of the reversible counter 132 with the timing T6 through the NAND gate 209, and the counter 132 is cleared to 0, 0. Furthermore, the output of the NAND gate 109 is transmitted to the LED control portion 110*a*, and the supply of electricity to the light emitting diode 80 of the encoder 110 is turned OFF after a delay of the time $D_4$ after the index switch is turned ON. Moreover, the output of the NAND gate 109 is transmitted to the input terminals of the NAND gates 112 and 113 through the integrating circuit, and the gates of the NAND gates 112 and 113 are interrupted. The pawl 69*a* is fitted into a concave recess 53 by the rotation of the base plate 49, and after this engagement, the rotation of the base plate 49 is stopped, and at this time, the base plate 49 vibrates slightly due to inertia, and the slit disc 78 vibrates so as to rotate in its rotating direction, and a pulse is generated by the vibration. Accordingly, when the swiveling motion of the slit disc 78 stops completely, an accurate indication is given on the display means 44 for the first time. For this reason, in this circuit, as described in the foregoing, the pawl 69 fits into the concave recess 53, and after the index switch 68 is turned ON, and the time $D_4$ has elapsed, the encoder 110 is turned OFF, and after a delay of the time $D_5$, the NAND gates 112 and 113 are closed whereby no error of the indicated angle occurs.

Even if the encoder 110 is turned OFF and the NAND gates 112 and 113 are closed, the indication of the display means 44 continues. For saving electricity, after a time interval after the index switch has been turned ON, the display means 14 may be turned OFF.

When the index operation is not carried out, the index switch 68 remains OFF. In this condition, the angle fixing manipulating member 86 vibrates in the fixing direction, and the undersurface of the brake plate 83 is urged against the upper surface of the index ring 52, and when the base plate 49, and the straightedges 41 and 42 are fixed to the support member 39 at a certain angle, the switch 93 is turned ON. Then a Low signal is transmitted to the input terminal of the delay circuit 94, and an operation similar to the case where the index switch 68 is turned ON takes place. When the index switch 68 or switch 69 is turned ON, this brings about the electricity saving condition, and in order to start the counting of the ruler angle again when the base plate is released, the reversible counter 142 counts one pulse with respect to the initial second pulse appearing at the output terminal of the polarity reversing circuit 120, and thereafter normally makes one pulse count for each fourth pulse.

The output pulse of the demultiplying circuit 131 is supplied to the input terminal of the upcount of the reversible counter 142 through the NAND gate 148, and the content of the binary counter portion of the counter 142 becomes 1 at the time $t_4$, and thereafter whenever a pulse enters, it changes to 0.1, 0.1, . . . , and the content of the octal counter portion of the counter 142 increases to 1, 2, 3, 4 . . . by the carry-up pulse from from the binary counter portion. The polarity "+", "−" displayed on the polarity display unit 44*a* will be determined by whether the level of the output terminal of the NAND circuit 123 is "High" or "Low", but in the case of this circuit, and when the output terminal of the NAND gate 123 is High, the polarity display unit 44*a* displays "−", and which the output is Low, it displays "+". Accordingly, in this case, the display unit 44*a* displays "+". and shows that the straightedge 41 is moved in a counterclockwise direction to the reference direction (base line).

The description has been given for the case where the quadrupled pulse appears at the multiplexer 114, but in the condition where the counters 142, 143, 144, 145 are clear, the straightedge 41 is vibrated in the clockwise direction, and if the quadrupled pulse appears at the output terminal 114*b* of the multiplexer 114, the output terminal of the NAND gate 123 becomes "High". The output pulse appears at the output terminal of the NAND gate 130, and in the above-mentioned region, the pulse is demultiplied to a one-fourth pulse, and is inputted to the upcount terminal of the counter 142. At this time, the polarity display unit 44*a* displays "−", and also displays that the straightedge 41 is positioned in the clockwise direction from the reference direction (base line). Next, consideration will be given to the operation where the polarity changes from "−" to "+".

First a description will be given of the case where a numerical value of "−" enters the counters 142, 143, 144, 145, and the straightedge 41 rotates in the counterclockwise direction, and continuous pulses appear at the output terminal of the NAND gate 112.

When the polarity is "−", the output terminal 124*a* of the NAND gate 124 becomes "Low". Accordingly, the output terminal of the NAND gate 126 changes to a "High" level. Accordingly, the continuous pulses appearing at the output terminal of the NAND gate 112 appear at the output terminal of the NAND gate 129 through the NAND gate 126. The output of the output terminal of the NAND gate 129 enters the downcount terminal of the counter 142 through the NAND gates 139 and 146 when the level of the output terminals 132*a* and 132*b* of the counter 132 change to 0, 1 as shown in FIG. 12. Accordingly, the contents of the counters 142, 143, 144, 145 gradually decrease. When the contents of the counters 142, 143, 144, 145 and the output terminal 132*a* of the counter 132 become "0", the output terminal 163*a* of the "0" detecting circuit 159 becomes "High". In this condition, the input terminal 124*b* of the NAND circuit 124 becomes "Low". Next, when the next pulse appears from the output terminal of the NAND gate 112, the output terminal 124*a* of the flip flop circuit reverses to the "High" condition. Namely, the polarity changes to "+". The output pulse appears from the output terminal of NAND gate 130, and this pulse appears as the one-fourth pulse from the output terminal of the AND gate 140, and enters the upcount terminal of the counter 142. Accordingly, the contents of the decimal and octal counters change to +1, +2, . . . . Also, similar actions occur where the "+" numerical value is inversely entered in the counter. Namely, where the polarity is "+", the output terminal of the NAND gate 123 is "Low", and the output terminal of the NAND gate 124 becomes "High", and in this condition, when a pulse appears at the output terminal of the NAND gate 129, the pulse is outputted to the output terminal of the NAND gate 129, whereby the contents of the decimal or octal counter change to +3, +2, . . . . When the content of the counter becomes "0", and the polarity is reversed, a pulse is outputted to the output terminal of the NAND gate 130, and the contents of the decimal and octal counters increase in the negative direction "−" such as −1, −2, −3, . . . .

Next, decription will be given with respect to the 6-notation function of the hexadecimal preset reversible counter 142. The content of the counter 142 increases 5 . 10 . 15 . 20 . 25 . . . . When the content becomes "55", the output terminal of the NAND gate 147 becomes "Low". When the next pulse comes from the AND gate 140 after the electric current passes to the NAND gate 149, the pulse is inputted to the upcount terminal of the counter 143 as a carry-up pulse, and at the same time, it passes the NAND circuit 151 and enters the clear terminal of the counter 142, and clears the counter 142. In these operating conditions, at the time when the counter 142 is cleared, due to the influence of the integrating circuit consisting of the resistor 153 and capacitor 155, the pulse does not appear at the output terminal of the NAND circuit 148. At the output terminal, the next pulse appears sequentially, and the pulse is supplied to the upcount terminal of the counter 142. By the foregoing operation, the content of the counter 142 changes to 45 . 50 . 55 . 00 . 05 . 10 . 15, . . . , whereby the octal portion of the counter 142 becomes a 6-notation upcounter.

Next, a description will be given with respect to the countdown.

When a pulse enters the downcount terminal of the counter 142, the content of the counter 142 decreases to 55 . 50 . 45 . 40 . 35. 30 . 25 . 20 . . . . At the time when the content becomes "00", the output terminal of the NOR gate 160 becomes "High". Then at the time when the next pulse appears at the downcount terminal of the counter 142, the pulse is outputted from the output terminal of the NAND gate 150. This pulse becomes the carry-down pulse to the next counter 143, and at the same time, it enters the terminal of the counter 142, and the content of the counter 142 is loaded at "55". In this case, the preset terminal of the counter 142 is required to be set to the "55" (0100) value. In these operations, at the time when the counter 142 is loaded at the value "55", due to the influence of the integrating circuit consisting of the resistor 152 and capacitor 154, the pulse does not appear at the output terminal of the NAND circuit 146. The next pulse appears at the output terminal of the NAND circuit 146. By the foregoing operation, the content of the counter 142 changes to . . . 20 . 15 . 10 . 05 . 00 . 55 . 45 . . . , whereby the octal portion of the counter 142 becomes a 6-notation downcounter. The carry-up and carry-down pulses of the counter 142 are transmitted to the counter 143, and are further transmitted to the succeeding counters 144 and 145, and the angles of the straightedge 41 to the reference direction (base line) are displayed digitally with a minimum display of 5 minutes and a maximum display of ±999 degrees 55 minutes.

Next, description of the tangent display will be given with referring to FIG. 10.

The output A (angle) of the updown counter 141 enters the input terminal of the TAN function converting circuit 174, and is converted to the TAN function to become the output B and is transmitted to the input terminal of the driver 165. On the other hand, the value of A is transmitted as it is to the input terminal of the driver 165. When the TAN/DEG changeover switch 67 is in the DEG position the value of A is displayed as the angle, but when the switch 67 is changed over to the TAN position the value of B is displayed as the TAN value on the display means 14. The display system represents the TAN value by a 3 digit figure according to the following.

Example $-1.23-4(=-1.23\times10^{-4})$ $1.\ 23\ 4\ (=1.\ 23\times10^{4})$

In the following, the memory operation will be described.

Where a certain optional angle A is displayed, upon the pressing of the addition key 64, the content A of the updown counter 141 and the content C of the memory circuit 169 are added in the addition circuit 167 to become (A+C), and this is stored in the memory circuit 169. Accordingly, if the initial condition of the memory circuit 169 is the clear condition, the display angle A is stored in the memory circuit 169. The time when the condition of the memory circuit 169 becomes the clear condition is the time when the power source switch 62 is turned ON, and the time when the memory clear key 65 is pressed, after the memory read operation is effected by pressing the memory read key 66.

After the completion of the memory operation, the content of the updown counter 141 is cleared automatically, and the display of the display means 44 becomes zero. Accordingly, the angle is counted using this point as the new base line. For this reason, by repeating the operation of A+C with the addition key 64, the base lines can be set sequentially, and as a result, the function of so called multiplex protracting can be carried out by the device.

Next, a description will be provided of the operation when the content of the memory circuit 169 is read.

When the content of the updown counter 141 is A, and the content of the memory circuit 169 is C, and the memory read key 66 is pressed, both values are added in the addition circuit 167 to produce (A+C), and this is preset in the updown counter 141. With the preset, the angle display of the display means 44 becomes the angle from the original base line prior to the employment of the memory circuit 169. After completion of the read operation, the content of the memory circuit 169 is cleared automatically. Accordingly, when the addition key 64 is pressed again at this time, the angle displayed on the display means at that time is stored in the memory circuit 169.

When the tangent is displayed, as described previously, the output of the updown counter 141 is converted to the tangent value and is displayed, and therefore, the content of the memory circuit 69 remains as the angle. Namely, in the updown counter 141, memory circuit 169, addition circuit 167, the operation the same as that for the angle display is effected to the memory clear key 65, addition key 64, memory read key 66, and the output of the final updown counter 141 is merely displayed after being converted to the tangent value. The foregoing description relates to the display of the tangent value, but the radian value or trigonometric function value such as the sine or cosine may be displayed instead.

Next, a description will be given of a straightedge fine adjusting device for adjusting the straightedges 41 and 42 and causing them to align accurately with a line on the drafting board.

With delete is set the base plate 49 is set free, the gear 55 is manipulated by the operator's fingers, and when the gear 56 is rotated, cover member 54 and base plate 49 are rotated around the center axes of the tubes 45 and 46, and the straightedges 41 and 42 are rotated in the plane parallel to the plane of the drafting board 32, and as a result the straightedges 41 and 42 can be aligned accurately with the desired line on the drawing paper. The fine adjusted rotary angles of the straightedges 41 and 42 are displayed on the display means 44 digitally.

When the pawl **69*a* is fitted into the concave recess 53 of the index ring 52, and the straightedges 41 and 42 are locked to the index ring 52, the base line adjusting means can be operated for causing the straightedges 41 and 42** to align with a line on the drawing paper.

When turned and the lever 92 is unscrewed from the thread portion of the shaft 91, and the knob 90 is rotated, the shaft 91 is shifted in the left and right directions according to the amount of eccentricity of the shaft 91 the shaft 91 in the hole in the knob 90. At this time, the ruler mounting member 40 moves swivelably around the pivot shaft 88 because it is interlocked with the shaft 91, and the straightedges 41 and 42 can be rotated in the range of ±7.5°. since a concave recess 53 is formed at each 15° around index ring 52, the straightedges 41 and 42 can be aligned with any given line on the drawing paper as described in the foregoing when the base plate 49 is locked in a concave recess 53 of the index ring 52 by the rotation of the knob 90. After the straightedges 41 and 42 are aligned with a given line on the drawing paper as described in the foregoing, if the counter reset switch 63 is pressed down, the content of the updown counter 141 is cleared to zero, and the display of the display means 44 becomes zero. The position of the straightedge 41 or 42 becomes a new base line, and, when the straightedges 41 and 42 are swiveled, the angle from the new base line is displayed digitally in the foregoing manner. Accordingly, the base line lever employed in the conventional drafting device is no longer required.

Next, the present invention will be described with respect to another embodiment shown in to FIG. 15 through FIG. 23.

Figure 15:
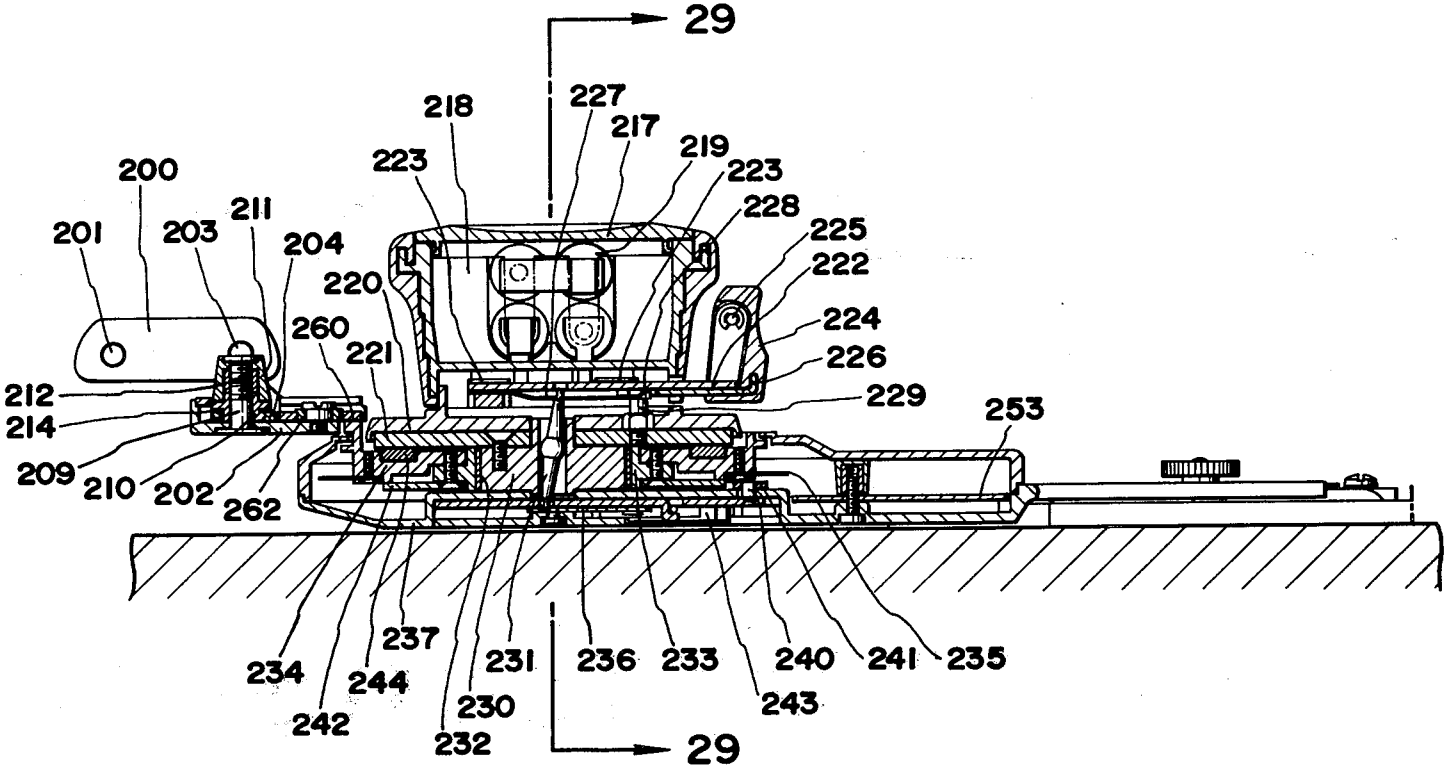
FIG. 15 is a cross section of the head showing another embodiment of the present invention.
Figure 16:
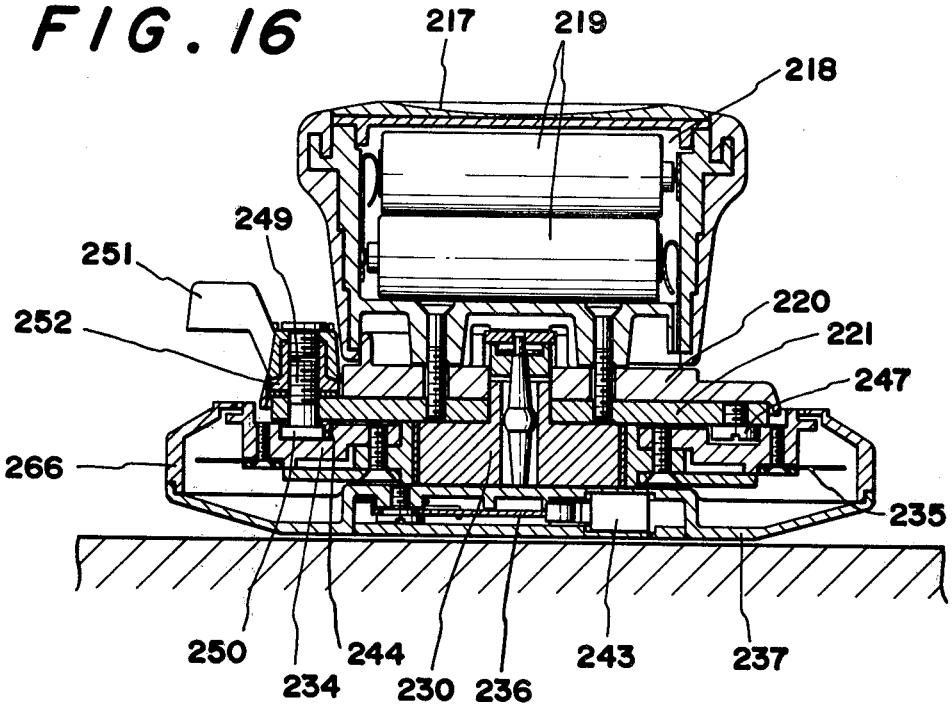
FIG. 16 is a cross section taken along a line 29—29.
Figure 17:
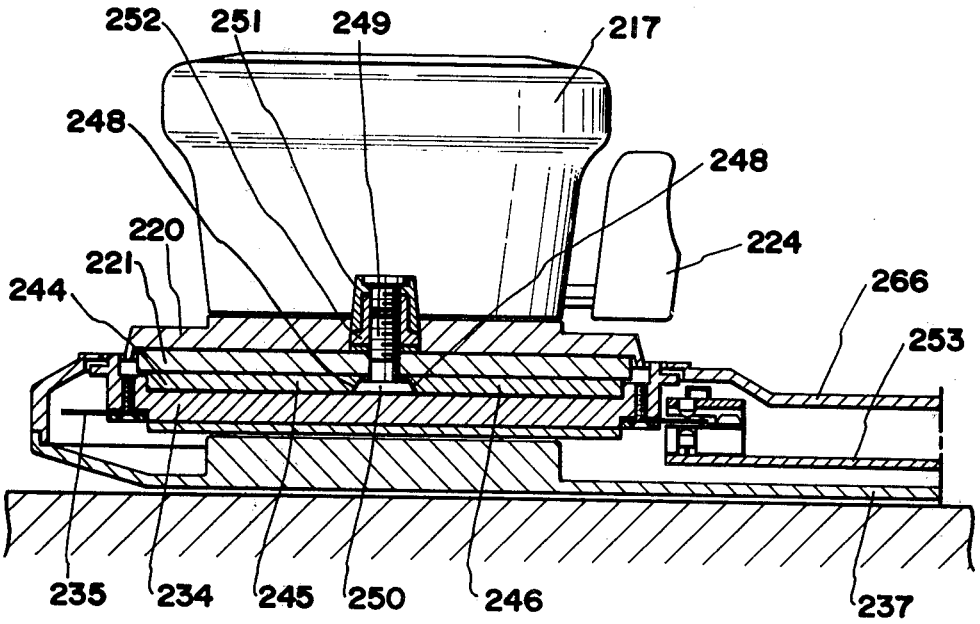
FIG. 17 is a cross section showing angle fixing means built into the head shown in FIG. 15.
Figure 18:
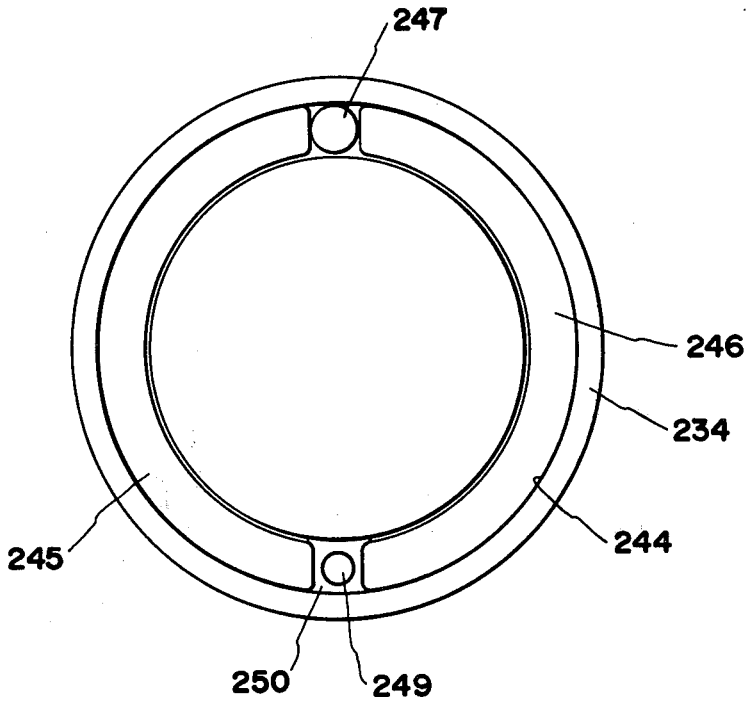
FIG. 18 is a plan view of the angle fixing means built in the head shown in FIG. 15.
Figure 19:
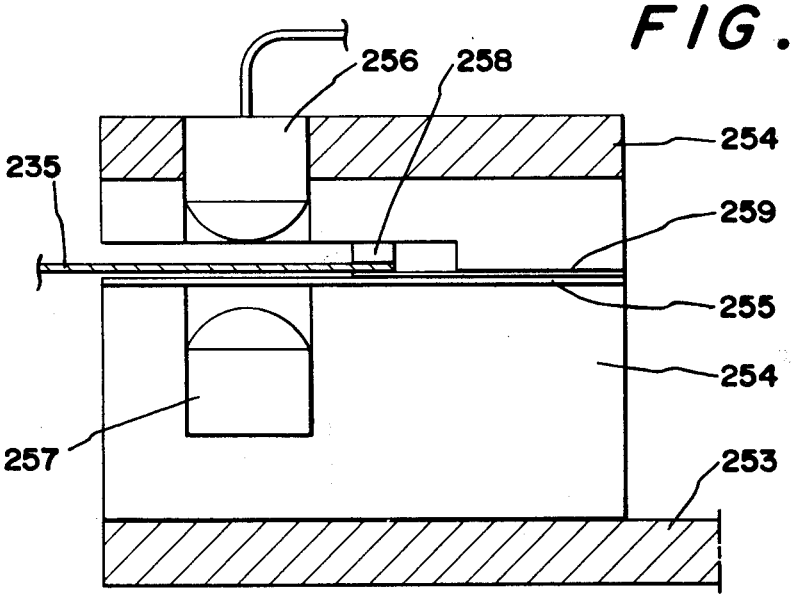
FIG. 19 is a side view, partly in section, of the incremental encoder built in the head shown in FIG. 15.

In FIG. 15, reference numeral 200 denotes a hinge member, and one end thereof is rotatably journaled at 201 on a vertically extending cursor (not shown). Numeral 202 denotes a support plate and a projection **202*a* on the plate 202 is rotatably journaled at 203 on the other part of the hinge member 200. Numeral 204 denotes an arm, and a hole 205 is provided in one end thereof (refer to FIG. 22), and an annular projecting portion provided at an eccentric position on a fine adjusting knob 206 is fitted rotatably in the hole 205. A shaft 208 is fitted into the knob 206, and one end of the shaft 208 is fixed to the support plate. The knob 206 is rotatably mounted on the shaft 208. Numeral 209 denotes a threaded shaft fixed to the support plate 202, and a cam 210 is rotatably fitted on the shaft. Numeral 211 denotes a lever to which a nut 212 and the cam 210 are fixed. The nut 212 is threaded onto to the thread portion of the threaded shaft 209. The cam 210 is fitted in a squre hole 213 at almost the middle of the arm 204. Between the bottom surface of the cam 210 and the top surface of the arm 204 is a washer 214. Numeral 215 denotes a spring having one end fixed to the free end of the arm 204, and the other end of the spring 215 projects toward and is resiliently in contact with the support plate 202. The arm 204 is urged in the clockwise direction around the shaft 208 in FIG. 20 by the resilient force of the spring 215. On one side of the arm 204 is a rack gear 216. Numeral 217 denotes a handle, and four batteries 219 are housed in a housing portion 218 formed in the interior of the handle. Members 220 and 221 are fixed to the handle 217 by screws. Numeral 222 denotes a transmitting plate, and the plate is supported for shifting movement in the left and right direction in FIG. 15 by a guide portion 223 on the member 220. A manipulating plate 224 is rotatably journaled at 225 on an upwardly extending portion of the transmitting plate 222, and one end of an elongated member 226 is fixed to the manipulating member 224. Numeral 227 denotes a plate spring fixed to the one end of the transmitting plate 222, and an upwardly extending portion 228 is formed on the other end thereof, and the portion 228 is loosely fitted into a hole formed in the elongated member 226. Numeral 229 denotes a stop which is fixed to the member 221. Numeral 230 denotes a main shaft which is fixed to the member 221 by a screw. A conical bar 231 is disposed in a hollow center portion of the main shaft 230, and the top end thereof is connected to the plate spring 227. A ring 232 is fitted on the outer periphery of the main shaft 230, and a panel 233 is rotatably fitted on the outer periphery of the ring 232. A flange portion of the panel 233 is fixed to a fixing plate 234 by a screw. A pulse transmitting member, namely, slit disc 235 consisting of an elastic member is fixed to the bottom surface of the fixing plate 234. Numeral 236 denotes a switch drive plate, and the middle portion thereof is connected to the lower end of the conical bar 231, and one end of the switch drive plate 236 is rotatably journaled at 238 to the straightedge mounting member 237. Numeral 239 denotes an elongated member which is connected to the switch drive plate 236 so as to be moved in the left and right directions in FIG. 15 with the switch drive plate. A shaft 240 projects from the elongated member 239, and the shaft 240 is fitted slidably in a long hole formed in a swiveling member 241. The elongated member 239 is urged in the left in FIG. 15 by the resilient force of a spring 239***a*. The straightedge mounting member 237 is rotatably journaled on one end of the swiveling member 241, and the other end of the swiveling member 241 is a pawl portion opposed to the outer periphery of the index ring 242. The index ring 242 is fixed to the flange portion of the panel 233. The straightedge member 237 is fixed to the bottom end surface of the main shaft 230. A limit switch 243 constitutes the ruler fixing and fixing releasing condition detecting means. The limit switch 243 is fixed to the straightedge mounting member 237. Numeral 244 denotes a groove formed along the circumferential groove formed in the top surface of the fixing plate 234, and arc-shaped brake bands 245 and 246 are disposed in the groove 244. One end of each of the brake bands 245 and 246 abuts the head portion of a screw 247 fixed to the member 221. The other end of each of the brake bands 245 and 246 has an inclined surface 248. Numeral 249 denotes a threaded lever that fits slidably into a hole formed in the member 221, and a brake cam 250 having an inclined surface corresponding to the inclined surface 248 of the brake bands 245 and 246 is formed on the bottom end of the threaded lever, and the inclined surface of a brake cam 250 contacts the inclined surface 248 of the brake bands 245 and 246. Numeral 251 denotes an angle brake lever and a nut 252 is fixed to the lever, and the nut 252 is threaded onto the thread portion of the lever 249. Between the bottom surface of the nut 252 and the top surface of the member 221 is a washer. Next, there will be described on an incremental encoder. Numeral 253 denotes an IC base plate fixed to the straightedge mounting member, and a vernier slit plate 255 is mounted on a plate member 254 formed integrally on the IC base plate 253 so that the plate 255 is positioned in parallel with the slit disc 235. A pair of phototransistors 256 and a pair of light emitting diodes 257 (LED), namely, signal detectors 256 and 257 are mounted on the plate member 254, with the slit disc 235 and the venier slit plate 255 disposed between them. Numeral 258 denotes a spring fixed to the plate member 254, and the spring 258 causes the slit disc 235 to contact the top surface of a spacer 259 under pressure. The spacer 259 is fixed to the top surface of the vernier slit plate 255. The spring 258 and the spacer 259 constitute an interval maintaining means for maintaining a constant interval between the slit disc 235 which acts as a pulse transmitting member and the signal detectors 256 and 257.

Figure 20:
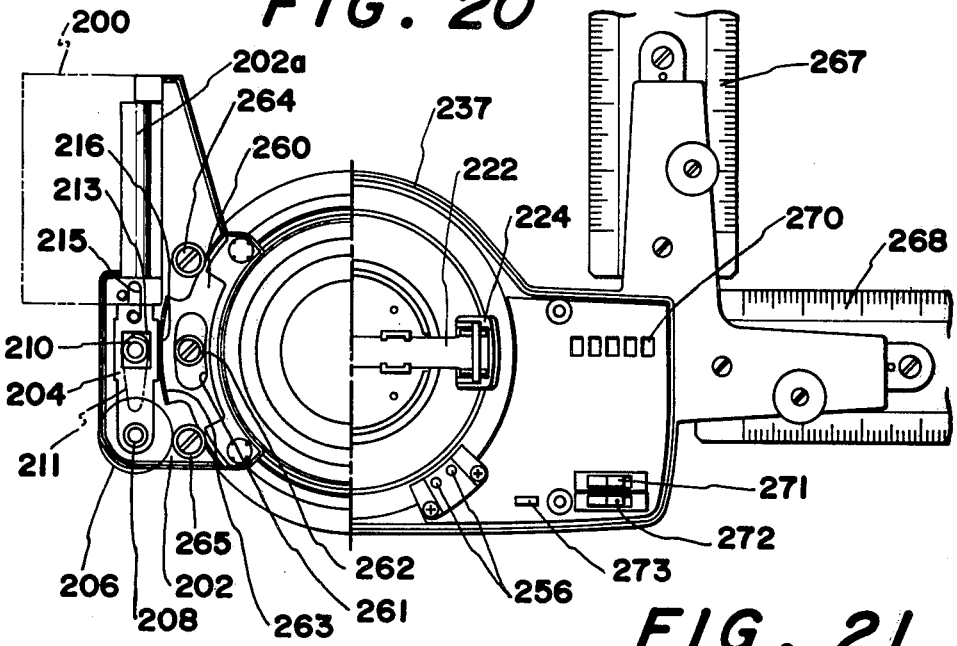
FIG. 20 is a plan view of the head shown in FIG. 15 partly broken away.
Figure 21:
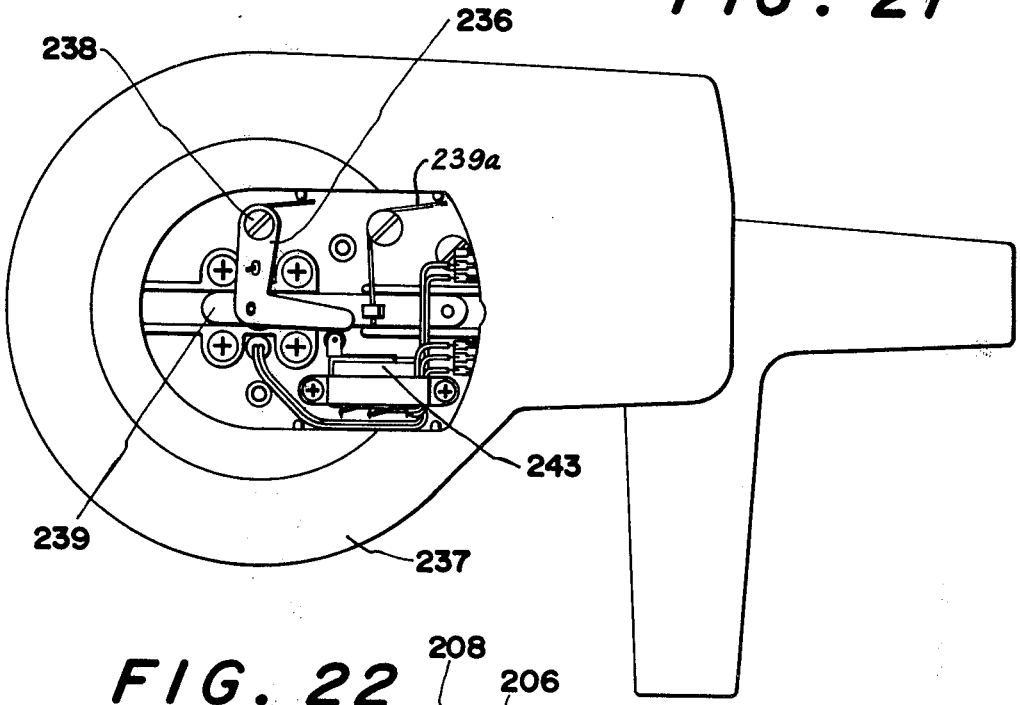
FIG. 21 is a bottom view of the head shown in FIG. 15.
Figure 22:
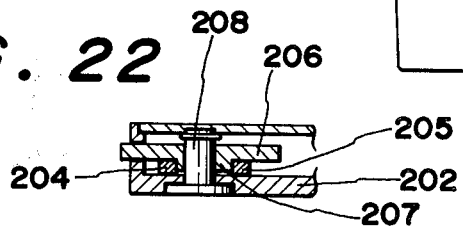
FIG. 22 is a cross section of base line adjusting means of the head shown in FIG. 15.

In FIG. 20, numeral 260 denotes a guide plate fixed to the fixing plate 234, and a long hole 261 is formed in the plate. A roller 262 which is rotatably mounted on the support plate 202 is fitted into the long hole 261. A rack gear 263 is formed on the arc-shaped side of the guide plate 260, and the rack gear 263 is meshed with the rack gear 216 on the arm 204. Numeral 264 and 265 denote rollers rotatably mounted on the support plate 202, and the rollers 264 and 265 come in contact with the side of the guide plate 260. Numeral 266 denotes a top cover which is fixed to the straightedge mounting member 237. Straightedges 267 and 268 are detachably fixed to the straightedge mounting member 237. A display means 270, main switch 272, least significant digit display changeover switch 271 and reset switch 273 are mounted on the top cover 266.

Figure 23:
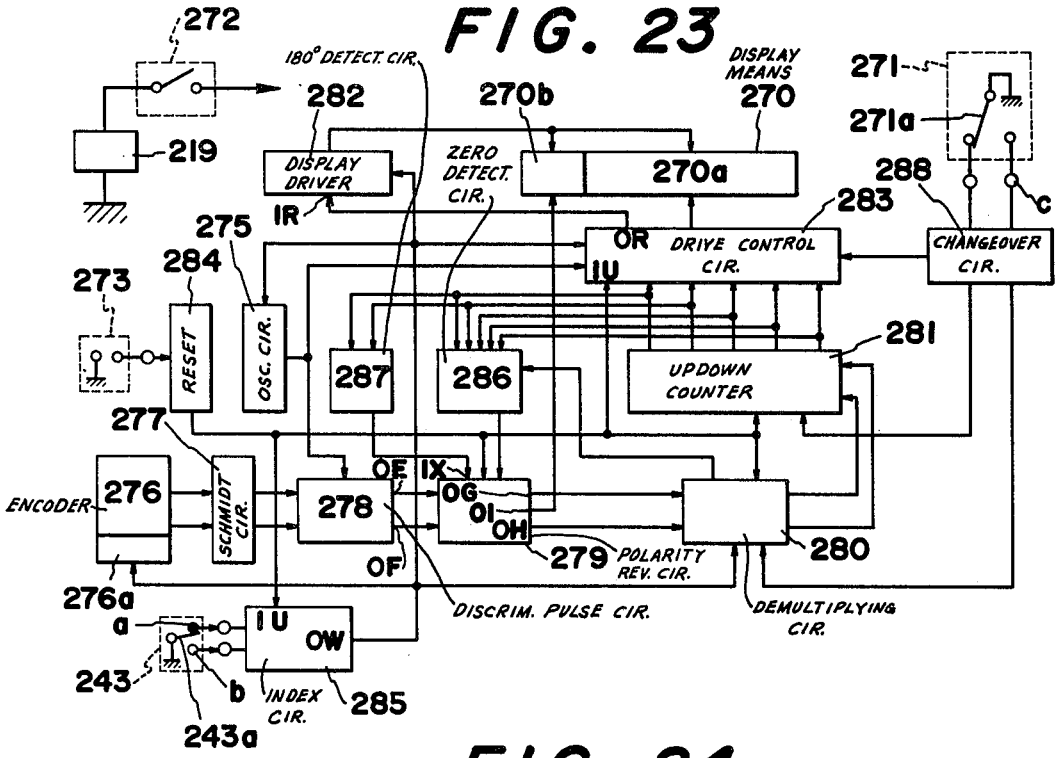
FIG. 23 is a block diagram showing the electronic circuit installed in the head shown in FIG. 15.

FIG. 23 is a block diagram of an information processing circuit of the present device, and the IC unit in the circuit is incorporated into the IC base plate 253. In the drawing, numeral 275 denotes an oscillation circuit and numeral 276 denotes an encoder consisting of the light emitting diode 257, phototransistor 256, slit disc 235, slit disc 235 and vernier slit plate 255, and the circuit is provided with a light emitting diode control unit 276. Numeral 277 denotes a Schmidt circuit, numeral 278 denotes a discriminating pulse circuit, numeral 279 denotes a polarity reversing circuit, numeral 280 denotes a demultiplying circuit, numeral 281 denotes a 5 digit updown counter, numeral 282 denotes a driver for display means numeral 283 denotes a dynamic drive control circuit, numeral 284 denotes an initial reset circuit, and numeral 270 denotes a display means which is composed of a numerical value display unit 270*a* and a polarity display unit 270*b*. Numeral 285 denotes an index circuit including a delay circuit, numeral 286 denotes a zero detecting circuit, 287 denotes a 180° detecting circuit, numeral 243 denotes a limit switch, numeral 273 denotes a reset switch, numeral 288 denotes a changeover circuit, and numeral 271 denotes a changeover switch.

Power from the battery 219 is supplied to the power line of the information processing circuit.

The operation of the present embodiment now be described.

Before performing manipulations for drafting, in the first place, the lever 211 is turned in the clamping direction, and the bottom surface of the cam 210 is urged against the top surface of the arm 204 under pressure through the washer, and the arm 204 is fixed to the support plate 202.

Next, the main switch 272 is turned ON. When the direction of the straightedges 267 and 268 is desired to be changed, the manipulating member 224 is pressed down and in the left direction in FIG. 15, and the transmitting plate 222 is shifted in the left direction. When the transmitting plate 222 is shifted in the left direction, the plate spring 227 is shifted in the left direction. At this time, the conical bar 231 is inclined in the counterclockwise direction about the bulged portion as a center. With the movement of the anticlockwise conical bar 231 in the counterclockwise direction, the switch drive plate 236 is swiveled in the counterclockwise direction in FIG. 21 about the shaft 238. By the swiveling motion of the switch drive plate 236, the limit switch 243 is tuned ON, the pawl portion of the switching member 241 not being completely released from the concave recess in the index spring 242. When the limit switch 243 is turned ON, the switch member 243*a* comes into contact with contact *a*. The index circuit 285 is operated when the movable switch member 243*a* contacts the contact *a*, and the drive signal is transmitted to the dynamic drive control circuit 283, to the driver 282 for display means and to control unit 276*a* of the encoder from the output OW of the index circuit 285. The encoder 276 receives the drive signal and as a result, the light emitting element 257 is energized, and also the angle of the straightedges 267 and 268 is displayed digitally on the display means 270. Then if the manipulating member 224 is pressed to the right in FIG. 15, the pawl portion of the swiveling member 241 leaves the concave recess in the index ring 242 completely, and with this motion, the straightedges 267 and 268 become free for swiveling. In the condition where the manipulating member 224 is pressed in the left direction in FIG. 15, when the manipulating member 224 is rotated in the counterclockwise direction around the shaft 225, the tip of the elongate member 226 pushes the plate spring 227 in the downward direction, and the portion 228 of the plate spring 227 abuts the left peripheral surface of the stop 229 in FIG. 15 and is stopped at the transfer position.

Next, the handle 217 is gripped by the operator's hand, and the handle 217 is rotated, and when the members 220, 221, main shaft 230 and straightedge mounting member 237 are rotated around the panel 233, the straightedges 267 and 268 are rotated in a plane parallel to the plane of the drawing board 32. With the rotation of the straightedge mounting member 237, the phototransistor 256, light emitting element 257, and vernier slit plate 255 are shifted along the slit disc 235 (pulse transmitting member). By this transfer, two kinds of pulses from the output terminal of the encoder 276 and which 90° out of phase, namely, SIN pulse and COS pulse signals are outputted. These SIN and COS pulse signals have their waveforms shaped by the Schmidt circuit 277, and are transmitted to the direction discriminating pulse quadrupling circuit 278. Whether the quadrupled pulse is outputted to the output terminal OE or OF is determined by the phase of the input pulse. The operation when a pulse appears at the output terminal OE of the circuit 278 will be described. When the reset switch 273 is set to ON, and all the contents of the updown counter 281 are cleared to zero, a signal is outputted to the input terminal of the flip flop of the polarity reversing circuit 279 from the zero detecting circuit 286. In this condition, when the timing pulse appearing at the output terminal OE of the circuit 278 is inputted to the flip flop circuit, the flip flop is reversed. In this condition, the pulse outputted from the output terminal OE of the circuit 278 appears at the output terminal OF of the polarity reversing circuit 279. The pulse appearing at the output terminal OF is supplied to the upcount terminal of the updown counter 281 through the demultiplying circuit. Moreover, the value of the updown counter 281 is transmitted to the dynamic drive control circuit 283, and the angle of the straightedge 268 with respect to the base line is displayed digitally on the display means 270 finally. At this time, "+" is displayed on the polarity display unit 270*b*, and the positioning of the straightedge 268 in the counterclockwise direction from the base line is indicated. In the condition where the updown counter 281 is in clear, when the straightedge 268 is swiveled in the clockwise direction, and the quadrupled pulse appears at the output terminal OF of the circuit 278, this pulse appears at the output terminal of the circuit 279 by the operation of the flip flop in the polarity reversing circuit 279. The pulse appearing at the output terminal OF is demultiplied to a one-fourth pulse, and is inputted to the updown counter 281. The polarity display unit 270*b* at this time displays "−", and indicates that the straightedge 268 is positioned in the clockwise direction with respect to the base line. If a certain "−" numerical value is stored in the updown counter 281, when the straightedge 268 is rotated in the counterclockwise direction, the pulse coming from the output terminal OE of the circuit 278 appears at the output terminal OF of the polarity reversing circuit 279, and the content of the counter 281 is sequentially decreased.

When the content of the counter 281 becomes zero, the next pulse appears at the output terminal OH of the circuit 279 by the operation of the flip flop of the polarity reversing circuit 279 that operates by the zero detecting circuit 286. At this time, the display of the polarity display unit 270*b* changes to "+". The pulse appearing at the output terminal OH enters the upcount terminal of the counter 281 through the demultiplying circuit 280, and the content of the counter 281 is sequentially increased. Also, conversely, similar actions occur when a "+" numerical value is in the counter 281, so that a description thereof will be omitted.

When the manipulating member 224 is swivelled to the original position in the clockwise direction around the shaft 225, the tip of the elongated member 226 rises, and the force of the plate spring 227 is released. With this operation, the contact of the portion 228 of the plate spring 227 and the stop 229 is ended. In this condition, the pawl portion of the swiveling member 214 in resilient contact with the outer periphery of the index ring 242, and in this condition, when the handle 217 is turned, the pawl portion of the swiveling member 214 engages in a concave recess in the index ring 242, and the straightedges 267 and 268 are fixed to the non-rotating portion of the head, namely, the panel 233. When the pawl portion of the swiveling member 241 engages in a concave recess in the index ring 242, the switch drive plate is turned by the resilient force of the spring to move the movable member of the limit switch 243, and the switch member 243*a* of the limit switch 243 contacts the contact b. When the switch member 243*a* of the limit switch 243 contacts the contact b, the delay circuit in the index circuit 285 starts its operation, and the signal from the circuit 285 is inputted to the control unit 276*a* of the encoder 276 and the driver 282 after a certain time delay. By this signal, the electric power supply circuit for the light emitting element 257 is opened, and the electric power supply to the light emitting element 257 is stopped, and the electric power supply circuit of the display means 270 is opened and the display means 270 is deenergized. When the switch drive plate 236 is returned to the original position, the transmitting plate 222 and manipulating member 224 are returned to the original position.

When the straightedge 267 or 268 is set at the base line, and the reset switch 273 is pressed, the reset signal appears from the output terminal of the initial reset circuit 284, and this reset signal is transmitted to the reset signal input side of the circuit unit. In this case, where the reset signal is inputted to the reset signal input terminal IU of the dynamic drive control circuit 283, all the signals to be transmitted to the input terminal IR of the driver 282 for display from the output terminal OR are stopped and the display means 270 is extinguished due to the ending of the operation of the display driver 282.

Next, when the operator releases the reset switch to remove the reset signal, the signal is transmitted to the input terminal IR of the display driver 282 from the output terminal OR of the dynamic drive control circuit 283, whereby the operation of the display driver 282 is initiated, and the display means 270 is lighted. In this case, the content of the updown counter 281 becomes "0" due to the reset signal so that as a matter of fact, the display means 270 displays "0". Even if the reset switch button 273 is kept pressed down, a timing circuit may be added to the initial reset circuit 284 so that the reset signal to be outputted from the output terminal of the initial reset circuit 284 is erased after the passage of a fixed time.

To carry out the generation described in the foregoing, i.e. turning the reset switch 273 to input the reset signal to the counter 283 and no display appears on the display means 270, and when the reset signal disappears, of the display on the display means 270, the operator turns the reset switch 273 on, releases it, and then confirms that the display means 270 is in the display condition, and only then can the rotating operation of the straightedge be carried out. Accordingly, the situation can be prevented in which the reset switch button 273 is kept pressed down and the straightedge is rotated, and only in the middle of the rotation is the reset switch button 273 released.

In the condition where the display means 270 is extinguished, when the reset switch button 273 is pressed, the reset signal is transmitted to the input side IU of the index circuit 285. When the reset switch button 273 is released, the delay circuit in the index circuit 285 starts its operation. At the same time, the signal is transmitted to the input terminal of the dynamic drive control circuit 283 and the driver 282 from the output terminal OW of the index circuit 285, and the display means 270 is lighted, and "0" is displayed thereon. Next, when a certain fixed time has elapsed (about 1.5 seconds in this embodiment), the operation of the delay circuit is completed, and the signal from the output terminal of the index circuit 285 is stopped, and the display means 270 is extinguished again.

As described in the foregoing, even if the electricity saving circuit operates and the display means 270 is placed in the display condition temporarily, the operator can confirm the reset condition simply by the reset switch manipulation.

In the condition where the manipulating member 224 is pressed down and the fixing of the straightedges 267 and 268 is released, the handle 217 is turned a large amount in the counterclockwise direction and the content of the counter 281 becomes +180°00′, the signal from the output terminal OX of the 180° detecting circuit 287 is transmitted to the input terminal IX of the polarity reversing circuit 279, and the polarity reversing circuit 279 is operated, and the polarity of the polarity display unit 270*b* is reversed to "−". Moreover, the supply line for the pulse to the counter 281 is changed over to the countdown line. Accordingly, when the straightedges 267 and 268 are given a turn, the content of the counter 281 becomes zero.

If the display 35 of the display means 270 displays 5 minute increments, the operation becomes 0′, +5′, +10′, . . . , +179°55′, 180°00′, −179°55′, . . . , −10′, −5′, 0′.

When one turn of the straightedges 267 and 268 in the clockwise direction is made, it is considered to resemble the foregoing case. The operation at this time becomes 0′, −5′, −10′, . . . , −179°55′, 180°00, +179°55′, . . . , +10′, +5′, 0′.

Next, a description will be given of the fixing of the straightedges to the nonrotating portion of the head at any given angle.

When the handle 217 is rotated, and the straightedges 267 and 268 are set at any given angle, and the angle brake lever 251 is turned in the clamping direction, the screw lever 249 is lifted by the nut 252, and the inclined surface of the brake cam 250 is urged against the inclined surface of the brake bands 245 and 246. With this arrangement, the brake bands 245 and 246 are displaced in the direction to cause the ring to expand in FIG. 18 starting at the screw 247, and the sides of the brake bands 245 and 246 are urged against the wall surface in the groove 244 of the fixing plate 234. When the brake bands 245 and 246 are urged against the wall surface of the groove 244, the member 221 is fixed to the fixing plate 234, and as a result, the straightedges 267 and 268 become fixed.

Next, in the condition where the straightedge mounting plate 237 is fixed to the index ring 242, the manipulation of the straightedge 267 or 268 with respect to the base line will be described.

In the first place, when the lever 211 is turned 45° in the counterclockwise direction from the dotted line position on FIG. 20, the connection of the arm 204 to the support plate 202 is released and the arm 204 becomes swivelable around the annular projection on the knob 206. When the lever 211 is turned in the counterclockwise direction in FIG. 20, the bulged portion of the cam 210 pushes the arm 204 in the left direction in FIG. 20 and the arm 204 is swiveled in the counterclockwise direction in FIG. 20 around the annular projection 207 on the knob. With the swiveling motion of the arm 204, the rack 216 moves out of contact with the rack 263. In this condition, when the handle 217 is turned, the guide plate 260 is guided by the rollers 262, 264, 265 and is turned on the support plate 202, and the straightedges 267 and 268 are turned a plane horizontal to the plane of the drafting board. The straightedges 267 and 268 can be turned in a range of ±7.5°, i.e. range of 15°.

Since the concave recesses in the index ring 242 are provided every 15°, when the straightedge mounting plate 237 is locked by the index ring 242, the straightedge 267 or 268 can be aligned with any given line on the drawing paper. The straightedge 267 or 268 is aligned with a given line on the drawing paper, and then if the reset switch 273 is pressed, the content of the updown counter 281 is cleared, and the display on the display means 270 becomes zero. Thus, the position of the straightedge 267 or 268 becomes the new base line at this time. When the lever 211 is turned in the clockwise direction on FIG. 20, the rack gear 216 is meshed with the rack gear 263, and moreover when the lever 211 is turned in the clockwise direction, the arm 204 is fixed to the support plate 202. By the manipulation of the lever 211, the guide plate 260 is fixed to the side of the support plate 202, and then the straightedges 267 and 268 are swiveled to the base line whereby the angle through which swiveling takes place amount together with the polarity are displayed on the display means 270.

When the lever 211 is turned 45° in the counterclockwise direction from the dotted line position on FIG. 20, the racks 216 and 263 are mutually engaged and also the arm 204 becomes the swivelable around the shaft 208. In this condition, when the knob 206 is turned, one end of the arm 204 moves in a circular motion in accordance with the eccentricity of the annular projection 207 on the knob 206 relative to the shaft 208. During this motion, the rack 216 on the arm 204 is constantly meshed with the rack 263 on the guide plate 260 by the spring 215. Accordingly, the circular motion of the end of the arm 204 is converted to a forward and backward motion of the rack 216 relative to the rack 263, and the guide plate 260 is rotated minutely around the main shaft 230 by the rotation of the knob 206. Consequently, by the rotation of the knob 206, the straightedges 267 and 268 can be minutely rotated in the plane horizontal to the plane of the drafting board while the index ring 242 is locked. When the handle 217 is rotated, and the angle of the straightedges 267 and 268 is changed, the phototransistor 256, light emitting element 257, and vernier slit plate 255 are shifted along the slit disc 235, but the outer peripheral end in the vicinity of the reading unit of the slit disc 235 is constantly held between the spring 258 and the spacer 259. Accordingly, the position of the slit plate 235 where the phototransistor 256 and light emitting elment 257 are positioned is controlled by the spring 258 and the spacer 259, and the interval between the slit disc 235 and the phototransistor 256 and the interval between the slit disc 235 and the light emitting element 257 are always maintained constant. With this arrangement, any pulse generation error of the encoder 276 can be eliminated.

When the switch member 271*a* of the changeover switch 271, for example, is caused to contact the contact c in the 10 minutes display position. The operation of the least significant digit of the 5-digit updown counter 281 is stopped by the output of the changeover circuit 288. Also, by the operation of the dynamic drive control circuit 283, the display means 270 is caused to display "0" constantly in the least significant digit position. On the other hand, the demultiply value of the demultiplying circuit 280 can also be changed. In this case, for example, for a 5 minute display, if it is operating for a $\frac{1}{4}$ demultiplication, and then for 10 minute display, it is changed to a $\frac{1}{8}$ demultiplication, while if at the time of 5 minute display, it is operating for a $\frac{1}{2}$ demultiplication, it is changed to a $\frac{1}{4}$ demultiplication for a 10 minute display. This changeover is not limited to a 5 minute and 10 minute display as mentioned above.

Figure 24:
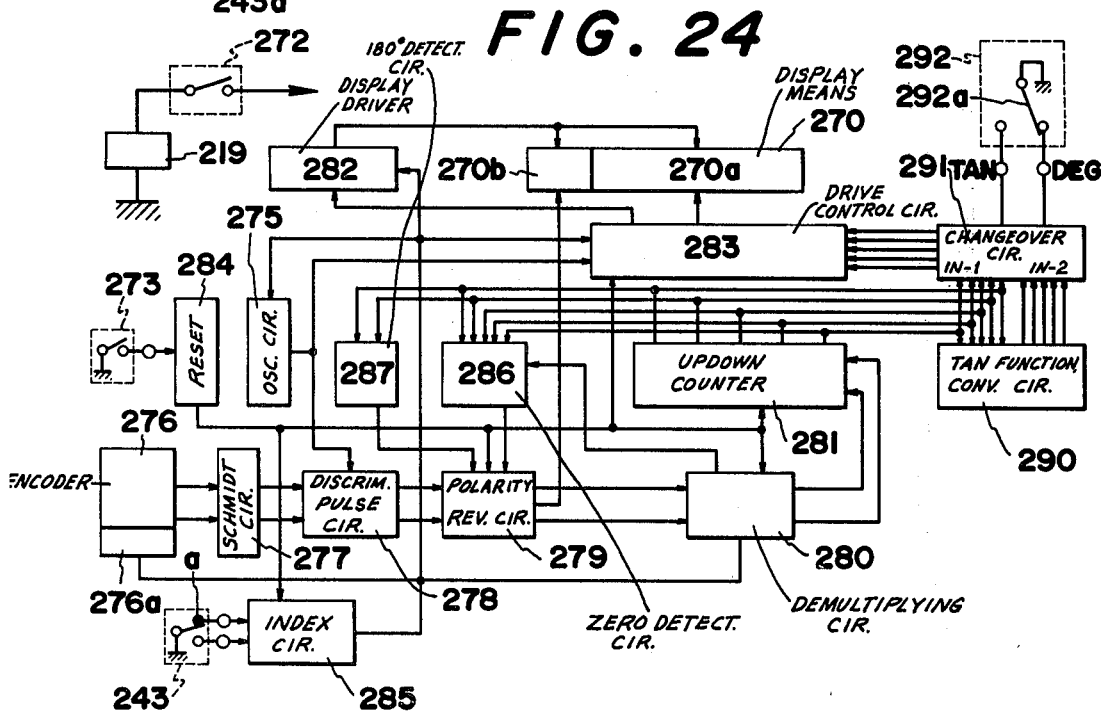
FIG. 24 is a block diagram of the electronic circuit shown in FIG. 23 to which an angle function converting circuit has been added.

Next, a description will be given in connection with to FIG. 24 of an embodiment wherein a tangent function circuit is added to the formation processing circuit as shown in FIG. 23.

The output A (angle) of the updown counter 281 enters the input terminal IN of the TAN function converting circuit 290, and it is converted to the tangent function in this circuit to output B (=tan A), and is transmitted to the input terminal IN−2 of the changeover circuit 291. On the other hand, the value A is transmitted to the input terminal IN−1 of the changeover circuit 291. In this circuit, in which a switch member 292*a* of the TAN/DEG changeover switch 292 is shown in the DEG position in the FIG., the value A from the output terminal of the changeover circuit 291 is transmitted to the input side of the dynamic drive control circuit 283. As a result, the digital value of the angle is displayed on the display means 270. When the switch member 292*a* of the TAN/DEG changeover 292 is changed over to the contact in the TAN position, the value B from the output terminal of the changeover circuit 291 is transmitted to the input side of the dynamic drive control circuit 283. As a result, the tangent value of the angle is displayed on the display means 270.

Figure 25:
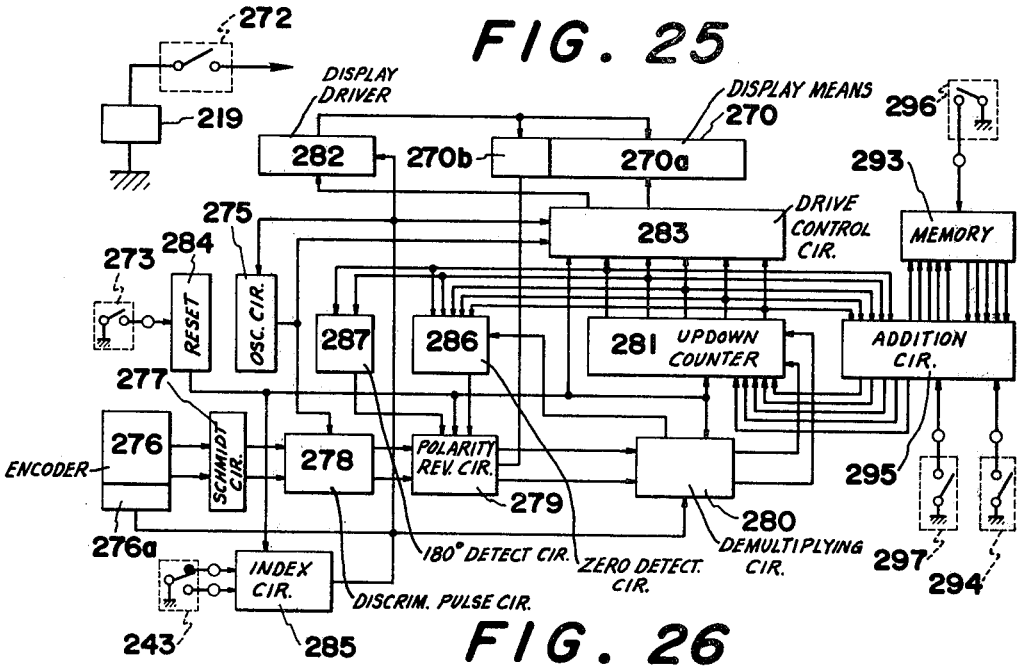
FIG. 25 is a block diagram of the electronic circuit shown in FIG. 24 to which a multiplex protracting circuit has been added.

Next, a description will be given in connection with FIG. 25 of an embodiment wherein a memory circuit and the addition circuit are added to an information processing circuit shown in FIG. 23.

Firstly, a description will be given of the operation of writing into the memory circuit 293.

When the display means 270 displays any given angle A, when M+ switch 294 is closed, the content A of the 5-digit updown counter 281 and the content C of the memory circuit 293 are added in an addition circuit 295 to produce (A+C), and this quantity is written in the memory circuit 293. Namely C′=A+C. Accordingly, if the initial condition of the memory circuit 293 is the reset condition, the display angle A is stored in the memory circuit 293. The memory circuit 293 is reset when the main switch 272 is turned ON, when a CM switch 296 is closed, and after a RM switch 297 is closed to effect the memory reading operation.

After the completion of the writing operation in response to the operation of the M+ switch 294, the content of the 5-digit updown counter 281 is reset automatically, and the display becomes zero. Accordingly, the position of straightedge becomes the new base line. For this reason, this device can carry out multiplex protraction by repeating the operation of C′=A+C by the actuation of the M+ switch 294. Accordingly, a multiplex protracting circuit is formed by the memory circuit 293 and the addition circuit 295. In the operation of reading out the contents of the memory circuit 293.

When the content of the 5-digit updown counter 281 is A and the content of the memory circuit 293 is C, when the RM switch 297 is pressed, the two values are added in the addition circuit 295 to produce (A+C), and this value is preset in the 5-digit updown counter 281. Namely, A=A+C. With this arrangement, the display angle becomes the angle from the original base line before using the memory circuit 293. After the completion of this operation, the content of the memory circuit 293 is reset automatically. Accordingly, at this time, when the M+ switch 294 is pressed again, the angle which is now displayed will be stored in the memory circuit 293.

Figure 26:
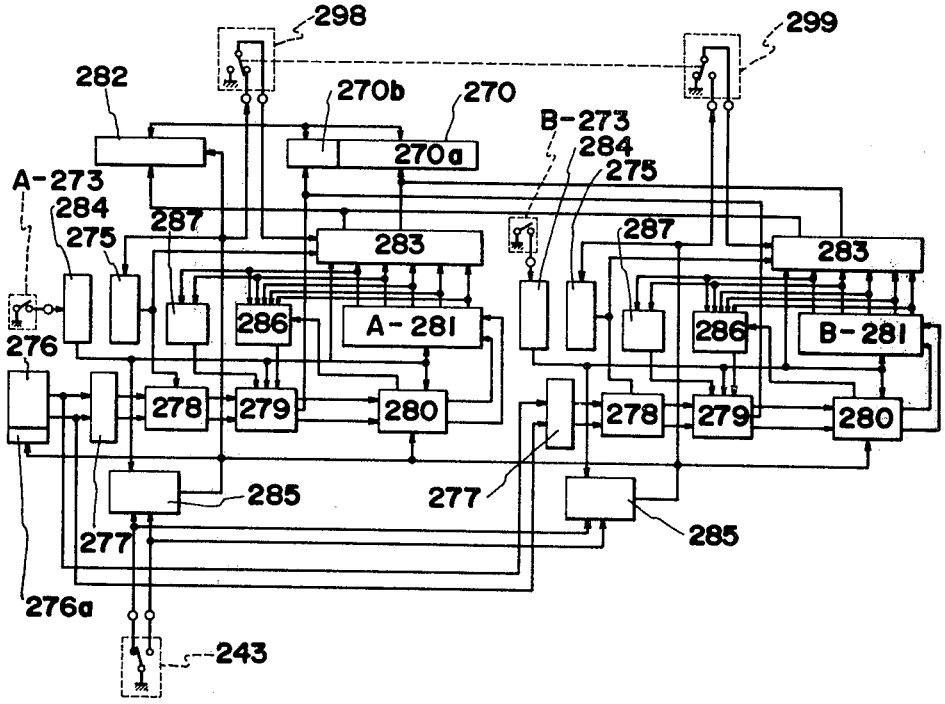
FIG. 26 is a block diagram showing an embodiment of the multiplex protracting circuit.

Next, description will be given of another embodiment of the multiplex protracting circuit shown in FIG. 26. As the block diagram shows, duplicate counter units other than the encoder 276, the driver 282 for display means, the display means 270 and the limit switch 243 are connected in parallel circuits, and a select switch 298 and an interlocking select switch 299 are connected to the respective parallel circuits to energize them. Either the value from the 5-digit updown counter A-281 or the counter B-281 can be displayed on the display means 270 dpending on which of the select switches 298 and 299 is closed. Also the content of the updown counter A-281 or B-281 can be independently reset due to the provision of the separate reset switches A-273 and B-273. As a result, the present device can have two different zero references. Namely, it can carry out double protraction. Also, similarly, three parallel circuits can be provided so that triple protraction can be carried out.

Figure 27:
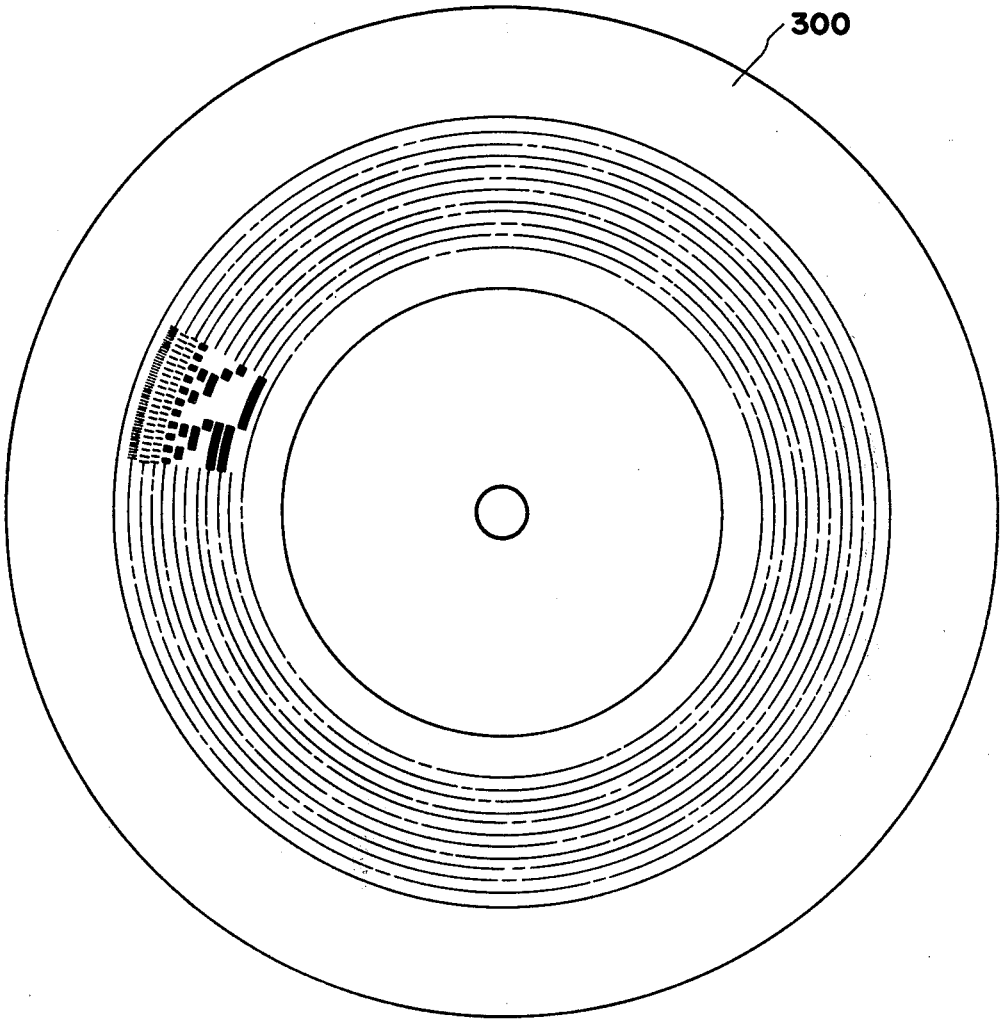
FIG. 27 is a plan showing a code plate of an absolute encoder.

Although the foregoing description relates to an embodiment wherein an incremental encoder is used, the means for effecting A-D conversion of the rotary motion of the straightedge is not particularly limited to an incremental encoder. An absolute encoder using a coding plate 300 shown in FIG. 27 can be used. The coding plate 300 can be mounted on the fixing plate 234.

What is claimed is:

1. A universal parallel ruler device comprising: a head having a non-rotatable portion; head supporting means for shiftably supporting the head during movement in a desired direction along a drafting board while maintaining the posture of the head; a straightedge rotatably mounted on the head; fixing means for detachably fixing the straightedge to the non-rotatable portion of the head; detecting means associated with said fixing means for detecting when the fixing means fixes the straightedge to said head and when the fixing means releases the straightedge from said head; an encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation, said display means having electrically operated light emitting elements; and an electricity saving circuit connected to said light emitting elements and to which said detecting means is connected for interrupting the supply of electricity to at least part of the light emitting elements in response to said detecting means detecting that the fixing means fixes the straightedge to said head and connecting the supply of electricity in response to said detecting means detecting that the fixing means has released the straightedge from said head.

2. A universal parallel ruler device comprising: a head having a non-rotatable portion; head supporting means for shiftably supporting the head during movement in a desired direction along a drafting board while maintaining the posture of the head; a straightedge rotatably mounted on the head; indexing means for detachably fixing the straightedge to the non-rotatable portion of the head at predetermined angular positions relative to said head; switch means associated with said indexing means for detecting when the indexing means fixes the straightedge to said head and when the indexing means releases the straightedge from said head; an encoder operatively associated with said head and said straightedge for converting the angle through which the straightedge rotates relative to said head to a pulse signal; an information processing circuit connected to said encoder for converting the pulse signals from said encoder to a digital value of the angle of rotation of the straightedge; display means connected to said processing circuit for displaying the digital value of the amount of straightedge rotation, said display means have electrically operated light emitting elements; and an electricity saving circuit connected to said light emitting elements and to which said switch means is connected for interrupting the supply of electricity to at least part of the light emitting elements in response to said switch means detecting that the indexing means fixes the straightedge to said head and connecting the supply of electricity in response to said switch means detecting that the indexing means has released the straightedge from said head.

3. A universal parallel ruler device comprising: a head having a non-rotatable portion; head supporting means for shiftably supporting the head during movement in a desired direction along a drafting board while maintaining the posture of the head; a straightedge rotatably mounted on the head; fixing means for detachably fixing the straightedge to the non-rotatable portion of the head; detecting means associated with said fixing means for detecting when the fixing means fixes the straightedge to said head and when the fixing means releases the straightedge from said head; an electrically operated encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation; and an electricity saving circuit connected to said encoder and to which said detecting means is connected for interrupting the supply of electricity to said encoder in response to said detecting means detecting that the fixing means fixes the straightedge to said head and connecting the supply of electricity in response to said detecting means detecting that the fixing means has released the straightedge from said head.

4. A universal parallel ruler device comprising: a head having a non-rotatable portion; head supporting means for shiftably supporting the head during movement in a desired direction along a drafting board while maintaining the posture of the head; a straightedge rotatably mounted on the head; fixing means for detachably fixing the straightedge to the non-rotatable portion of the head; detecting means associated with said fixing means for detecting when the fixing means fixes the straightedge to said head and when the fixing means releases the straightedge from said head; an encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; electrically operated display means connected to said processing circuit for displaying the digital value of the amount of straightedge rotation; and an electricity saving circuit connected for interrupting the supply of electricity to said display means in response to said detecting means detecting that the fixing means fixes the straightedge to said head and connecting the supply of electricity in response to said detecting means detecting that the fixing means has released the straightedge from said head.

5. A universal parallel ruler device as claimed in claim 4, further comprising a reset switch connected to said information processing circuit for resetting the information processing circuit, and an electronic circuit connected to said display means and to which said reset switch is coupled for automatically maintaining the display means in a display condition for a fixed time when a reset signal is supplied from said reset switch.

6. A universal parallel ruler device as claimed in claim 4, further comprising a reset switch connected to said information processing circuit for resetting the information processing circuit, and an electronic circuit connected to said display means and to which said reset switch is coupled for automatically maintaining the display means in a display condition for a fixed time when a reset signal is supplied from said reset switch.

7. A universal parallel ruler device as claimed in claim 5 further comprising a reset switch connected to said information processing circuit for resetting the information circuit, and an electronic circuit connected to said display means and to which said reset switch is connected for placing the display means in a non-display condition when a reset signal is being applied to said information processing circuit and simultaneously with the ending of the reset signal to the information processing circuit, for causing the display means to be placed in a display condition.

8. A universal parallel ruler device comprising: a head having a non-rotatable portion; head supporting means for shiftably supporting the head during movement in a desired direction along a drafting board while maintaining the posture of the head; a straightedge rotatably mounted on the head; fixing means for detachably fixing the straightedge to the non-rotatable portion of the head; an encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; an electrically operated display means connected to said processing circuit for displaying the digital value of the amount of straightedge rotation, and an electricity saving circuit connected to said display means and to which said fixing means is connected and including time delay means for interrupting the supply of electricity to said display means a predetermined time after said fixing means fixes the straightedge to said head and connecting the supply of electricity when the fixing means has released the straightedge from said head.

9. A universal parallel ruler device comprising: a head having a non-rotatable portion; head supporting means for shiftably supporting the head during movement in a desired direction along a drafting baord while maintaining the posture of the head; a straightedge rotatably mounted on the head; fixing means for detachably fixing the straightedge to the non-rotatable portion of the head; detecting means associated with said fixing means for detecting when the fixing means fixes the straightedge to said head and when the fixing means releases the straightedge from said head; an electrically operated encoder operatively associated with said head and said straightedge for converting the angle through which the straightedge relates relative to said head to an information signal; and information processing circuit connected to said encoder for converting the information signals from said encoder to a digital value of the angle of rotation of the straightedge; and further having an updown counter display means connected to said processing circuit for displaying the digital value of the amount of straightedge rotation; and electricity saving circuit connected to said encoder and to which said detecting means is connected for interrupting the supply of electricity to said encoder in response to said detecting means detecting that the fixing means fixes the straightedge to said head and connecting the supply of electricity in response to said detecting means detecting that the fixing means has released the straightedge from said head; a pulse passing gate connected between said encoder and said updown counter for supplying an output signal from the encoder to the updown counter; and a delaying circuit connected between said detecting means and said pulse passing gate for supplying a release indicating signal indicating that the fixing means has released the straightedge from the head to the pulse passing gate for turing said gate ON after a delay of a predetermined time from the time when the said release indicating signal reaches the encoder and the encoder is turned ON.

10. A universal parallel ruler device as claimed in claim 8 in which said delaying circuit includes means for delaying a fixing indicating signal indicating that the fixing means has fixed the straightedge to the head for predetermined time before it is supplied to the encoder and the pulse passing gate for interrupting the current supply to the encoder and turning the pulse passing gate OFF.

11. A universal parallel ruler comprising: a head having a non-rotatable portion; head supporting means for shiftably supporting the head during movement in a desired direction along a drafting board while maintaining the posture of the head; a straightedge rotatably mounted on the head; fixing means for detachably fixing the straightedge to the non-rotatable portion of the head; a manipulating member connected with said fixing means for manipulating said fixing means in the fixing and releasing operation; switch means associated with said manipulating member for detecting when the manipulating member is actuated for fixing the straightedge to said head and when it is actuated for releasing the straightedge from said head; an electrically operated encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation, and an electric power supply circuit connected to said encoder and to which said switch means in connected for interrupting the supply of electricity to said encoder in response to said switch means detecting that the manipulating member has been manipulated to the straightedge to said head and connecting the supply of electricity in response to said switch means detecting that the manipulating means has been manipulated to release the straightedge from said head.

12. A universal parallel ruler device comprising: a head; head supporting means for shiftably supporting the head during movement in a desired direction along a drafting board while maintaining the posture of the head; a straightedge rotatably mounted on the head; an encoder operatively associated with said head and said straightedge for converting the angle through which the straightedge rotates relative to said head in both the clockwise and counterclockwise directions to a digital pulse signal having an indication of the direction of rotation; a countup line and a countdown line; a direction discriminating circuit connected between said encoder and said lines for supplying the pulse digital signal to one of the lines; an updown counter connected to the countup and countdown lines for counting the pulse digital signals; display means connected to said counter for displaying the count value counted by the counter; a zero value detecting circuit for detecting when the value of the content of the counter is zero; a 360 divisor value detecting circuit for detecting when the value of the content of the counter is evenly divisible into 360; and a reversing circuit connected to said lines and to which said value detecting circuits are connected for changing over the pulse digital signal from one line to the other in response to a signal from the zero value and 360 divisor value detecting circuits, whereby when the straightedge is turned starting from a zero degree position, the value in the counter increases from zero and when it reaches a value divisible into 360, for example 180, the 360 divisor value detecting circuit actuates the reversing circuit and the pulse input path to the counter is changed from the countup line to the countdown line, and when the straightedge is further turned, the content of the counter is reduced from the value at the 180 value and the absolute value in the counter becomes zero at a position where the straightedge completes one turn, and the display on the display means becomes the zero.

13. A universal parallel ruler device comprising: a head; head supporting means for shiftably supporting the head during movement in a desired direction along a drafting board while maintaining the posture of the head; a straightedge rotatably mounted on the head; an encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation; and a multiplex protractor circuit connected to said information processing circuit for supplying a plurality of base positions of the straightedge to said information processing circuit.

14. A universal parallel ruler device comprising: a head; head supporting means for shiftably supporting the head during movement in a desired direction along a drafting board while maintaining the posture of the head; a straightedge rotatably mounted on the head; an encoder operatively associated with said head and said straightedge for converting the angle through while the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation; and a function converting circuit connected to said information processing circuit and said display means of the information processing circuit to a value of a function of the angle of the straightedge displaying it on the display means.

15. A universal parallel ruler device comprising: a head; head supporting means for shiftably supporting the head during movement in a desired direction along a drafting board while maintaining the posture of the head; a handle rotatably mounted on said head; a straightedge mounted on the handle; an encoder operatively associated with said head and said straightedge for converting the angle through which the straightedge rotates relative to said head to an information signal; an information processing circuit connected to said encoder for converting the information signals from said encoder to a digital value of the angle of rotation of the straightedge; display means connected to said processing circuit for displaying the digital value of the amount of straightedge rotation; and battery mounting means in said handle connected to said encoder, processing circuit and display means for accommodating batteries for the power supply for said device.

16. A universal parallel ruler device comprising: a head; head supporting means for shiftably supporting the head during movement in a desired direction along a drafting board while maintaining the posture of the head; a straightedge rotatably mounted on the head; an encoder operatively associated with said head and said straightedge and having an elastic plate serving as a pulse transmitter and a signal detector opposed to said plate to converting the angle through which the straightedge rotates relative to said head to a pulse signal; for keeping the interval therebetween; constant interval maintaining means between the pulse transmitting member and the detector at a constant value; an information processing circuit connected to said encoder for converting pulse signals from said encoder to a digital value of the angle of rotation of the straightedge; and display means connected to said processing circuit for displaying the digital value of the amount of straightedge rotation.

* * * * *